US011786948B2

(12) United States Patent
Imanari et al.

(10) Patent No.: US 11,786,948 B2
(45) Date of Patent: Oct. 17, 2023

(54) ROLL STATE MONITOR DEVICE

(71) Applicant: Toshiba Mitsubishi-Electric Industrial Systems Corporation, Tokyo (JP)

(72) Inventors: Hiroyuki Imanari, Tokyo (JP); Yukihiro Yamasaki, Tokyo (JP)

(73) Assignee: TOSHIBA MITSUBISHI—ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 204 days.

(21) Appl. No.: 16/652,073

(22) PCT Filed: Aug. 28, 2019

(86) PCT No.: PCT/JP2019/033734
§ 371 (c)(1),
(2) Date: Mar. 30, 2020

(87) PCT Pub. No.: WO2021/038760
PCT Pub. Date: Mar. 4, 2021

(65) Prior Publication Data

US 2021/0060630 A1 Mar. 4, 2021

(51) Int. Cl.
*B21B 1/22* (2006.01)
*B21B 13/14* (2006.01)

(52) U.S. Cl.
CPC ..... *B21B 1/22* (2013.01); *B21B 13/14* (2013.01); *B21B 2265/12* (2013.01)

(58) Field of Classification Search
CPC ..... B21B 1/22; B21B 13/14; B21B 2265/12; B21B 38/08; B21B 37/66; B21B 37/58; B21B 2267/08; G01M 1/20–24
USPC ..... 72/19.6, 10.4, 6.1–14.7
See application file for complete search history.

(56) References Cited

U.S. PATENT DOCUMENTS 9,242,283 B2 * 1/2016 Imanari ..... B21B 37/66

FOREIGN PATENT DOCUMENTS

| | | | |
|---|---|---|---|
| DE | 10 2018 201 586 | A1 | 9/2018 |
| JP | 63-40608 | A | 2/1988 |
| JP | 1-317613 | A | 12/1989 |
| JP | 2-108404 | A | 4/1990 |

(Continued)

OTHER PUBLICATIONS

Machine translation of DE 102018201586 (Year: 2018).*

(Continued)

*Primary Examiner* — Katrina M Stransky
*Assistant Examiner* — Teresa A Guthrie
(74) *Attorney, Agent, or Firm* — XSENSUS LLP

(57) ABSTRACT

A roll state monitor device includes: rolling force detector configured to detect rolling force of a monitored roll selected from an upper roll set and a lower roll set; force variation value extractor configured to extract a rolling force variation value based on the rolling force for each rotation position of the monitored roll; and identification part configured to identify a roll eccentricity amount of the monitored roll by acquiring a plurality of accumulated values by accumulating separately for each rotation position of the monitored roll a value which is one of the rolling force variation value and a roll gap equivalent value calculated based on the rolling force variation value, and by dividing each of the plurality of accumulated values by a correction coefficient corresponding to a roll rotation amount.

8 Claims, 18 Drawing Sheets

(56) References Cited

FOREIGN PATENT DOCUMENTS

| | | | |
|---|---|---|---|
| JP | 2003-211209 | A | 7/2003 |
| JP | 5637637 | B2 | 10/2014 |
| WO | 2012/070099 | A1 | 5/2012 |
| WO | 2018/216215 | A1 | 11/2018 |

OTHER PUBLICATIONS

European Office Action dated Jan. 29, 2021 in the corresponding European patent application No. 19863985.8.
Extended European Search Report dated Oct. 15, 2021, in European Patent Application No. 21187118.1, 8 pages.
International Search Report and Written Opinion dated Nov. 26, 2019 for PCT/JP2019/033734 filed on Aug. 28, 2019, 9 pages.

* cited by examiner

ROLL STATE MONITOR DEVICE

CROSS-REFERENCE TO RELATED APPLICATION

The present application is based on PCT filing PCT/JP2019/033734, filed Aug. 28, 2019, the entire contents of which are incorporated herein by reference.

TECHNICAL FIELD

The present application relates to a roll state monitor device.

BACKGROUND

Conventionally, for example, as described in JP-A-63-040608, an apparatus for detecting and correcting eccentricity of rolls used in a rolling apparatus is known. The device of claim 1 in the patent publication, for example, includes: means for supplying the electrical pressure signal to a narrow band filter having a bandwidth characteristic to pass a change in a signal at a frequency representing the eccentricity of the rolls; means for receiving the filtered signal and generating an electrical display signal based on the signal; and means for applying the electrical display signal to a viewable display for subjecting an operator's consideration to indicate the magnitude of the eccentricity of the roll. In the eccentricity alarm device according to this publication, the display (reference numeral 50) is configured to output an audible and/or visual alarm to the operator when the eccentricity exceeds a predetermined value.

Further, conventionally, for example, as described in Japanese Patent No. 5637637, a plate thickness control device configured to identify a roll eccentricity amount is known. Identification techniques for an amount of roll eccentricity are described in, for example, paragraphs 0016 and 0117 of this patent publication. For example, the paragraph 0016 describes identifying the roll eccentricity amount of the upper and lower backup rolls, and calculating a work roll gap command value between the upper work roll and the lower work roll based on the identified roll eccentricity amount.

CITATION LIST

Patent Literature

[PTL1] JP 63-040608 A1
[PTL2] JP 5637637 A1

SUMMARY

Technical Problem

In general, rolling force of the roll is acquired from an output signal of a rolling force sensor. Abnormal sensor output signals may be transmitted due to noise, etc. If it is done based on one rolling force detection value to calculate one identification value or to perform one roll state determination, a large amount of accuracy deterioration occurs when one abnormal value is mixed therein. As a result, the abnormal value mixed therein causes a problem of a large amount of deterioration in identification accuracy of a roll eccentricity amount or a large amount of deterioration in determination accuracy of a roll state.

For example, JP-A-63-040608 described above teaches two determination techniques relating to a roll eccentricity amount. The first technique is a determination method in which an operator examines size of roll eccentricity by watching contents on a display. The second technique is an eccentricity alarm device which gives an alarm when an eccentricity degree exceeds a predetermined value. When using these techniques, a roll state may be determined to be abnormal in a case where one abnormal value due to a noise signal causes a high degree of eccentricity. In this case, an incorrect alarm is issued.

Further, the above-described Japanese Patent No. 5637637 discloses merely a roll eccentricity amount identify technique described in paragraphs 0016 and 0117 and the like, at most. That is, in this publication, as described above, it is not recognized that the abnormal value mixed therein causes a problem of identification accuracy deterioration in the roll eccentricity amount. As described above, the prior art has still left room for improving determination accuracy in a roll state.

The present application has been made in order to solve the problems as described above, and an object thereof is to provide a roll state monitor device having improved identification accuracy or improved determination accuracy of a roll state.

Solution to Problem

A first roll state monitor device according to the present application includes: rolling force detecting means; force variation value extracting means; and identification means. When a rolled material is rolled between an upper roll set having at least one roll and a lower roll set having at least one roll, the rolling force detecting means is configured to detect rolling force of a monitored roll selected from the upper roll set and the lower roll set. The force variation value extracting means is configured to extract a rolling force variation value based on the rolling force for each rotation position of the monitored roll. The identification means is configured to identify a roll eccentricity amount of the monitored roll by acquiring a plurality of accumulated values by accumulating separately for each rotation position of the monitored roll a value which is one of the rolling force variation value and a roll gap equivalent value calculated based on the rolling force variation value, and by dividing each of the plurality of accumulated values by a correction coefficient corresponding to a roll rotation amount which is number of times the monitored roll is rotated in an accumulation period in which the plurality of accumulated values are acquired.

The correction coefficient is preferably a variable value which is set to be larger as the number of times that the monitored roll is rotated in the accumulation period of the plurality of accumulated values becomes larger. The correction coefficient may be, for example, the same value as the number of times the monitored roll is rotated, or the correction coefficient may be set less or more than the number of times the monitored roll is rotated. The division correction based on the correction coefficient can convert the accumulated value accumulated over a certain period into a value corresponding to a rotation amount of the monitored roll.

In the first roll state monitor device, the identification means may be configured so as to convert the rolling force variation value into the roll gap equivalent value by using a roll gap conversion formula including a plastic coefficient of the rolled material. To explain the reason, since there are a hard rolled material and a soft rolled material according to steel type, it is preferable to distinguish the difference in these hardness. A conversion formula including a plastic coefficient makes it possible to accurately identify the roll eccentricity amount by setting each plastic coefficient for each rolled material, which is preferable.

The monitored roll may have a first side end portion and a second side end portion opposite to the first side end portion. The first side may be, for example, an operator side (OS). The second side may be, for example, a drive side (DS). The rolling force detecting means may be configured to detect first side rolling force of the first side end portion while detecting second side rolling force of the second side end portion. The force variation value extracting means may be configured to extract each of a first side rolling force variation value and a second side rolling force variation value. The first side rolling force variation value is a value of the first side rolling force for each rotation position of the monitored roll. The second side rolling force variation value is a value of the second side rolling force for each rotation position of the monitored roll. The identification means may be configured to acquire the plurality of accumulated values corresponding to the plurality of rotation positions based on the first side rolling force variation value and the second side rolling force variation value with respect to each of the first side end portion and the second side end portion separately, and to identify each roll eccentricity amount of the first side end portion and the second side end portion.

In the first roll state monitor device, identification means for identifying each separate roll eccentricity amount for the first side end portion and the second side end portion may be specifically configured as follows. The identification means may acquire a plurality of first side accumulation values which are a plurality of accumulated values corresponding to a plurality of rotation positions of the first side end portion by accumulating separately one of a value of the first side rolling force variation value and a first side roll gap equivalent value calculated based on the first side rolling force variation value for each rotation position of the monitored roll. The identification means may acquire a plurality of second side accumulation values which are a plurality of accumulated values corresponding to a plurality of rotating positions of the second side end portion by accumulating separately one of a value of the second side rolling force variation value and a second side roll gap equivalent value calculated based on the second side rolling force variation value for each rotating position of the monitored roll. The identification means may identify the roll eccentricity amount for each of the first side end portion and the second side end portion by dividing each of the first side accumulation value and the second side accumulation value by a correction coefficient corresponding to number of times the monitored roll is rotated.

The first roll state monitor device may further include roll state determining means. The roll state determining means may determine a state of the monitored roll in a second rolling period by collating the roll eccentricity amount calculated by the identification means to a determination criterion. The determination criterion may be a predetermined reference value which is determined in advance. The predetermined reference value may be a fixed value, or may be a variable set value. The determination criterion may be a "normal roll eccentricity representative value" generated by applying a technique of a second roll state monitor device to be described later. The determination criterion may be updated at any timing.

The second roll state monitor device according to the present application includes rolling force detecting means, force variation value extracting means, identification means, recording means, and roll state determining means. When a rolled material is rolled between an upper roll set having at least one roll and a lower roll set having at least one roll, the rolling force detecting means is configured to detect rolling force of a monitored roll selected from the upper roll set and the lower roll set. The force variation value extracting means is configured to extract a rolling force variation value which is a value of each rolling force for each rotation position of the monitored roll. The identification means is configured to identify a roll eccentricity amount based on the rolling force variation value. The recording means records a plurality of roll eccentricity amounts calculated from the identification means in accordance with a plurality of rotation positions of the monitored roll in a first rolling period which is determined in advance. The roll state determining means determines a state of the monitored roll in a second rolling period which is after the first rolling period, based on a normal roll eccentricity amount representative value which is a representative value calculated from the plurality of the roll eccentricity amounts calculated by the identification means in the first rolling period, and based on the roll eccentricity amount calculated by the identification means in the second rolling period.

In the second roll state monitor device, the "representative value" may be a known value, referred to as a summary statistic. Known summary statistics are, for example, averages, standard deviations, medians, ranges and mode values. The normal roll eccentricity amount representative value may be either a normal roll eccentricity amount peak-to-peak value, a normal roll eccentricity amount maximal average value, or a normal roll eccentricity amount minimal average value.

The normal roll eccentricity amount peak-to-peak value is a difference between a maximum value and a minimum value among a plurality of roll eccentricity amounts calculated in a predetermined rolling period which is set in advance. This is also referred to as a "range" which is a kind of summary statistic. A waveform acquired by arranging in a time series the plurality of roll eccentricity amounts in the predetermined rolling period may also be referred to as an "eccentricity amount data waveform". The normal roll eccentricity amount maximal average value may be an average value of a plurality of positive eccentricity amount peak values included in the eccentricity amount data waveform. The normal roll eccentricity amount minimal average value may be an average value of a plurality of negative eccentricity amount peak values included in the eccentricity amount data waveform. The predetermined rolling period may be a period which is taken by rolling process of a predetermined amount of the rolled material. Further, the predetermined rolling period may be a period from the start of rolling process to elapse of a predetermined time.

The first rolling period may be a time required to roll a single of the rolled material, or may be a time required to roll a predetermined plural number of the rolled materials. The first rolling period may be a predetermined time regardless of the number of the rolled materials. The second rolling period may be the same length as the first rolling period, or may be longer or shorter than the first rolling period.

In the second roll state monitor device, the roll state determining means may be configured to determine the state of the monitored roll by comparing another representative value of the roll eccentricity amount acquired in the second rolling period with a multiplied value acquired by multiplying the normal roll eccentricity amount representative value by a predetermined coefficient. The other representative value is the same type of numerical value as the representative value calculated from the plurality of the roll eccentricity amounts calculated by the identification means in the second rolling period.

In the second roll state monitor device, the roll state determining means may be configured to determine the state of the monitored roll based on a test result of a statistical test method for a plurality of the roll eccentricity amounts. The statistical test method may be selected from a variety of known test methods. The statistical test method may be a chi-square test as an example. The roll state determining means may determine the state of the monitored roll based on a plurality of the roll eccentricity amounts according to an outlier detection method based on the Hotelling theory.

A third roll state monitor device according to the present application includes rolling force detecting means, signal extracting means, and roll state determining means. When a rolled material is rolled between an upper roll set having at least one roll and a lower roll set having at least one roll, the rolling force detecting means is configured to detect a rolling force signal detected in a monitored roll selected from the upper roll set and the lower roll set. The signal extracting means extracts from the rolling force signal a rolling force high frequency signal having a frequency equal to or larger than a predetermined frequency which is set in advance. The roll state determining means is configured to determine a state of the monitored roll based on test results of a statistical test method for a plurality of rolling force values included in the rolling force high frequency signal.

In the third roll state monitor device, the roll state determining means may calculate a rolling force value probability density distribution based on the plurality of rolling force values. Furthermore, the roll state determining means may be configured to determine the state of the monitored roll based on comparison between the rolling force value probability density distribution and a reference distribution which is set in advance. Further, in the third roll state monitor device, the roll state determining means may include normal distribution roll state determining means, or may include Rayleigh distribution roll state determining means, or may be configured to include at least one of these means. The normal distribution roll state determining means may calculate a probability density distribution of the plurality of rolling force values as the rolling force value probability density distribution, and may use a normal distribution as the reference distribution. The Rayleigh distribution roll state determining means may calculate, as the rolling force value probability density distribution, a maximal-minimal probability density distribution which includes each probability density distribution of a plurality of rolling force maximal values and a plurality of rolling force minimal values included in the rolling force high frequency signal. The Rayleigh distribution roll state determining means may use a Rayleigh distribution as the reference distribution. When the roll state determining means includes both the normal distribution roll state determining means and the Rayleigh distribution roll state determining means, the monitored roll may be determined to be abnormal if at least one of determination results thereof is abnormal.

In the third roll state monitor device, as an example, standard deviation $\sigma$ of a plurality of rolling force values may be calculated. A normal distribution may be compared with a probability density distribution of $\pm k\sigma$ which is calculated by multiplying a predetermined coefficient k and this standard deviation $\sigma$. The test result may be a numerical value acquired by calculating difference between the probability density distribution and the normal distribution. Alternatively, the test result may be a numerical value acquired by calculating difference between the maximal-minimal probability density distribution and a Rayleigh distribution. The calculated difference between plural probability density distributions may be expressed as one value selected from a group consisting of a Kullback-Leibler Divergence, an error sum of squares, and an error absolute sum of values.

In the third roll state monitor device, the monitored roll may have a first side end portion and a second side end portion opposite to the first side end portion. The rolling force detecting means may be configured to detect a first side rolling force signal from a first rolling force sensor provided on the first side end portion and to detect a second side rolling force signal from a second rolling force sensor provided on the second side end portion. The signal extracting means may extract each rolling force high frequency signal having a frequency equal to or larger than the predetermined frequency from the first side rolling force signal and the second side rolling force signal. The roll state determining means may be configured to determine each state of the first side end portion and the second side end portion of the monitored roll based on the test result of the statistical test method for each rolling force high frequency signal extracted by the signal extracting means.

In the third roll state monitor device, a roll state may be determined based on the "each test result for each rolling stand" which is a test result of the statistical test method for each of a plurality of rolling stands. In this case, in the third roll state monitor device, the upper roll set may include a plurality of upper roll sets which constitutes a plurality of rolling stands. The lower roll set may include a plurality of lower roll sets which constitutes the plurality of rolling stands together with each of the plurality of upper roll sets. The rolling force detecting means may acquire a plurality of rolling force signals from each rolling force sensor provided with each of the plurality of rolling stands. The signal extracting means may extract from each of the plurality of rolling force signals a plurality of rolling force high frequency signals each having a frequency equal to or larger than the predetermined frequency. The roll state determining means may be configured to acquire each test result for each rolling stand corresponding to the plurality of rolling stands as the test result of the statistical test method for the plurality of rolling force values included in each of the plurality of rolling force high frequency signals, and to determine the state of the monitored roll based on each test result for each rolling stand.

In the first to third roll state monitor devices, the "monitored roll" may include at least one of an upper monitored roll and a lower monitored roll. The "upper monitored roll" is one roll selected from the "upper roll set". The "lower monitored roll" is one roll selected from the "lower roll set".

The upper roll set includes an upper work roll. In addition, the upper roll set may include an upper backup roll and may include an upper intermediate roll. When the upper roll set consists of only the upper work roll, the upper monitored roll is the upper work roll. When the upper roll set consists of the upper work roll and the upper backup roll, at least one of the upper work roll and the upper backup roll is selected as the upper monitored roll. When the upper roll set consists of the upper work roll, the upper backup roll, and the upper intermediate roll, at least one of the upper work roll, the upper backup roll, and the upper intermediate roll is selected as the upper monitored roll.

The lower roll set includes a lower work roll. In addition, the lower roll set may include a lower backup roll and may include a lower intermediate roll. When the lower roll set consists of only the lower work roll, the lower monitored roll is the lower work roll. When the lower roll set consists of the lower work roll and the lower backup roll, at least one of the lower work roll and the lower backup roll is selected as the lower monitored roll. When the lower roll set consists of the lower work roll, the lower backup roll, and the lower intermediate roll, at least one of the lower work roll, the lower backup roll, and the lower intermediate roll is selected as the lower monitored roll.

In the first to third roll state monitor devices, the monitored roll may include both the upper monitored roll and the lower monitored roll. In this case, each roll state determination of the upper monitored roll and the lower monitored roll may be performed independently.

In the first roll state monitor device and the second roll state monitor device, the rolling force detecting means may detect each of upper rolling force detected in the upper monitored roll and lower rolling force detected in the lower monitored roll by distributing an output signal from a rolling force sensor by a predetermined ratio. The predetermined ratio may be 1:1, or may be a ratio other than this. Further, in this case, the force variation value extracting means may extract an upper rolling force variation value which is a value of the upper rolling force for each rotation position of the upper monitored roll, and may extract a lower rolling force variation value which is a value of the lower rolling force for each rotation position of the lower monitored roll, and these extraction may be performed independently with each other.

Advantageous Effects

According to the first roll state monitor device of the present application, the accumulated value acquired by accumulating the rolling force or the roll gap equivalent value is determined for each roll rotation position. By correcting each accumulated value with the correction coefficient corresponding to the roll rotation amount, it is possible to calculate the roll eccentricity amount for each roll rotation position. This results in an advantage that accurate identification is possible since it is possible to suppress the accuracy deterioration due to an abnormal value caused by noise or the like as compared with a case where one identification value is calculated from one rolling force detection value in a one-to-one relationship.

In the second roll state monitor device of the present application, the normal roll eccentricity amount representative value is a value representative of a plurality of roll eccentricity amounts which the identification means calculates when the monitored roll is normal. The normal roll eccentricity amount representative value is used as a determination criterion for roll state. The normal roll eccentricity amount representative value is generated based on actual identification data acquired when the monitored roll is normal in past rolling period. By using the normal roll eccentricity amount representative value based on a plurality of roll eccentricity amounts, it is possible to create an appropriate roll state determination criterion for each rolling plant while suppressing influence of abnormal values. Thus, there is an advantage of improving determination accuracy of the roll eccentricity amount.

According to the third roll state monitor device according to the present application, it is possible to statistically determine whether or not a plurality of rolling force values in the rolling force high frequency signal is within a range of normal value. It is possible to accurately determine presence or absence of roll eccentricity abnormality based on an overall tendency in roll state determination based on statistical test, rather than roll state determination depending on a single or a small number of data detection results. Thus, it is possible to monitor roll eccentricity abnormality with high accuracy.

BRIEF DESCRIPTION OF DRAWINGS

FIG. 1 is a diagram for explaining an example of a rolling mill which a roll state monitor device according to a first embodiment is applied to;

DESCRIPTION OF EMBODIMENTS

First Embodiment

Figure 1:
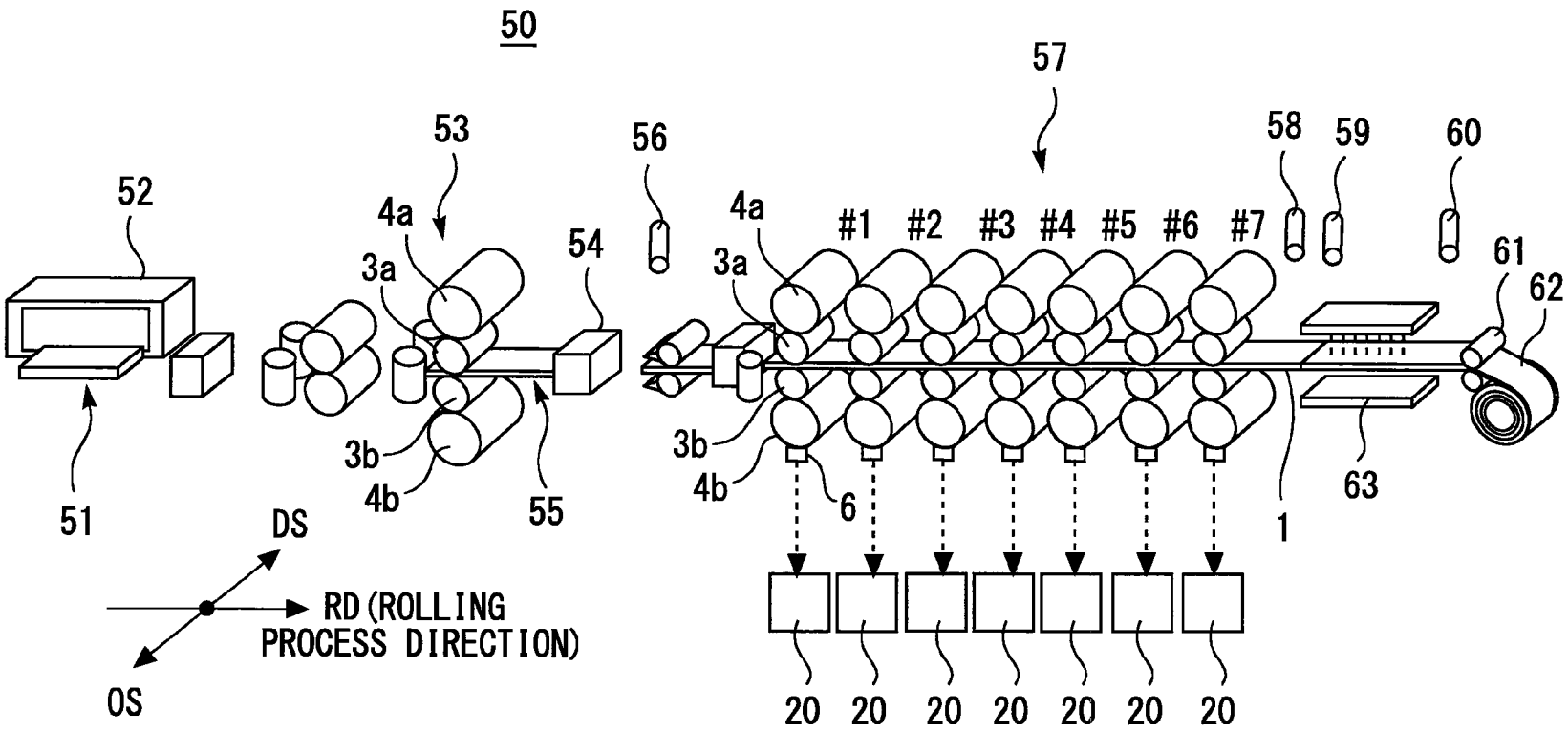

FIG. 1 is a diagram illustrating an example of a rolling mill 50 which a roll state monitor device 20 according to the first embodiment is applied to. The rolling mill 50 in FIG. 1 includes a heating furnace 52 for heating a slab 51, a roughing mill 53, a bar heater 54 for heating a bar 55, a finishing rolling mill 57, an entry pyrometer 56 disposed on an entry side of the finishing rolling mill 57, a strip thickness/width meter 58 for measuring a strip thickness and a strip width, a delivery pyrometer 59 disposed on a delivery side of the finishing rolling mill 57, a run-out table 63, a pyrometer 60, a coiler 61, and the roll state monitor device 20.

The pyrometer 60 is disposed on an entry side of the coiler 61. The coiler 61 forms a product coil 62. FIG. 1 illustrates a rolling direction RD, an operator side OS, and a drive side DS. The roll state monitor device 20 according to the first embodiment is provided as one function included in a control device to control the rolling mill 50 for rolling a rolled material 1.

In the embodiment, the rolling mill 50 in hot sheet rolling process will be described as a specific example. Although the first embodiment exemplarily illustrates the rolling mill 50 including the roughing mill 53 having two stands and the finishing mill 57 having seven stands, this is an example.

In general, rolling mills can facilitate production of automobiles and electrical products by rolling and thinning ingots of steel materials or non-ferrous materials such as aluminum and copper. There are various types of rolling mills. Various types of rolling mills include hot sheet rolling mills for rolling plate materials, cold rolling mills, rolling mills for rolling bar wires, rolling mills such as H-shaped steel, 12-Hi rolling mills and 20-Hi rolling mills for rolling hard materials such as stainless steel, and the like. There are various types of rolls for each rolling configuration. These various types of rolling mills may use the roll state monitor device 20 according to the first embodiment. This is because various types of rolling mills in practical use are often similar in configuration to each other although details thereof are different.

The rolling mill 50 illustrated in FIG. 1 is provided with the roughing mill 53 having two stands and the finishing rolling mill 57 having seven stands. Furthermore, although not shown, a large capacity electric motor is provided for driving the rolls on upper side and lower side. Although not shown, shafts or the like to connect the rolls and the motor are also provided.

The roughing mill 53 in FIG. 1 may have a total of four rolls of work rolls 3*a*, 3*b* and backup rolls 4*a*, 4*b* having larger diameter than the work rolls 3*a*, 3*b*, or a total of two rolls of work roll 3*a*, 3*b*. On the other hand, the finishing rolling mill 57 in FIG. 1 includes a first rolling stand #1 to a seventh rolling stand #7.

Each rolling stand of the finishing rolling mill 57 is a set of four rolls including upper rolls and lower rolls. In other words, the work rolls 3*a*, 3*b* and the backup rolls 4*a*, 4*b* are included. One or more intermediate rolls may be provided between each work roll 3*a*, 3*b* and each backup roll 4*a*, 4*b*, and in this case one rolling stand may have six or more rolls from the upper side to the lower side.

The roll state monitor device 20 according to the first embodiment monitors a roll state in the finishing rolling mill 57. However, as a modification, the roll state monitor device 20 may monitor a roll state of the roughing mill 53, or the roll state monitor device 20 may monitor roll states of both the roughing mill 53 and the finishing rolling mill 57.

The roll state monitor device 20 according to the first embodiment is configured to monitor the state of the rolls, to detect an abnormality of the rolls so as to inform the abnormality in advance. The roll state monitor device 20 can accurately identify a roll eccentricity amount, and the identified roll eccentricity amount is compared with a roll eccentricity amount in a normal state to determine abnormality. The roll state monitor device 20 may include various types of notification means, such as a display device or an alarm signal, for presenting determination results of a roll state to an operator or the like.

Figure 2:
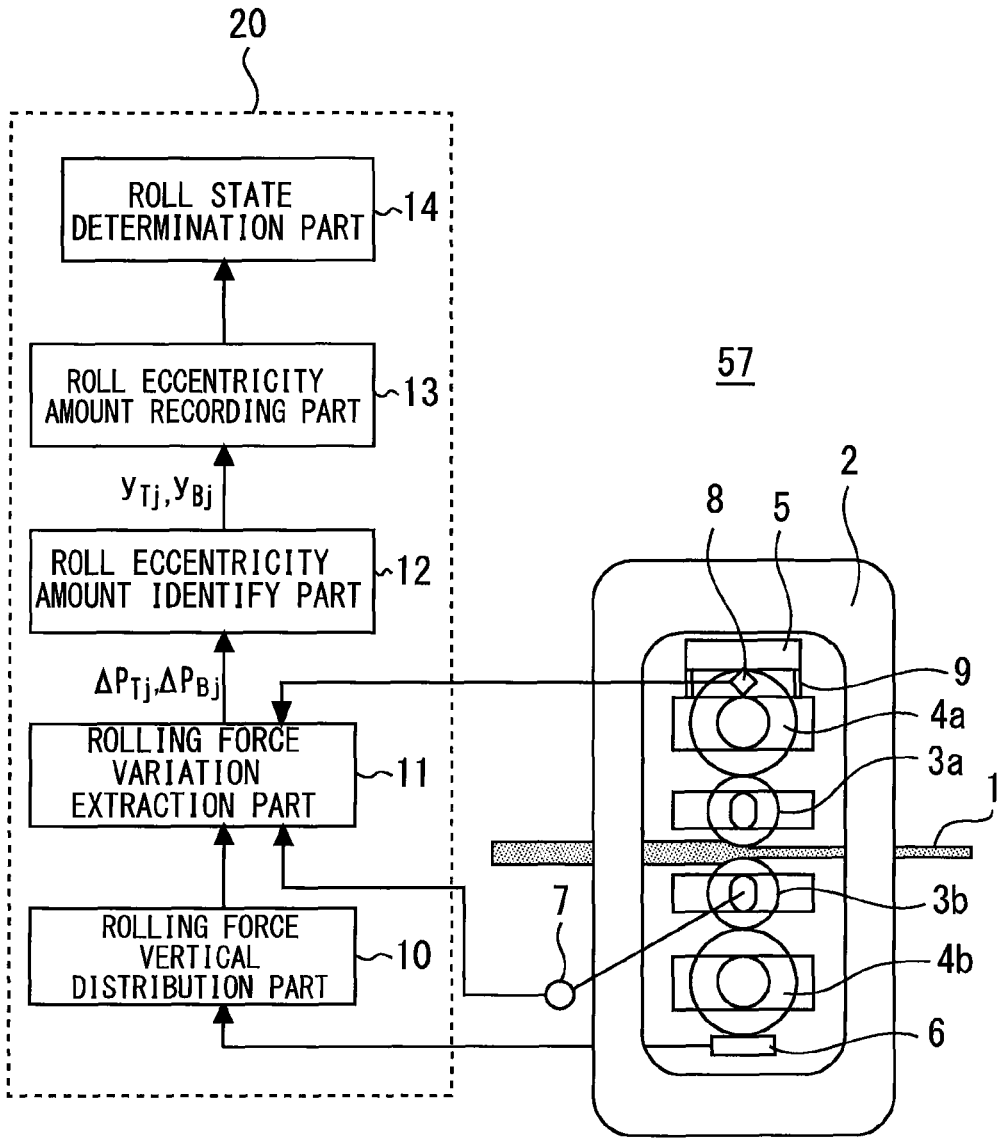
FIG. 2 is a diagram for explaining configuration of the roll state monitor device and an upper roll set and a lower roll set according to the first embodiment.

FIG. 2 is a diagram for explaining a configuration of the roll state monitor device 20 and the upper roll set and the lower roll set according to the first embodiment. FIG. 2 illustrates one rolling stand in the finishing rolling mill 57 according to the first embodiment, and the roll state monitor device 20 connected thereto.

The configuration in FIG. 2 is included in each of the first rolling stand #1 to seventh rolling stand #7 of the finishing rolling mill 57 in FIG. 1. As shown in FIG. 2, each rolling stand includes a housing 2, work rolls 3*a*, 3*b*, back-up rolls 4*a*, 4*b*, screw down means 5, rolling force detecting means 6, a roll rotation amount detector 7, a roll reference position detector 8, and a roll gap detector 9.

As shown in FIG. 2, the work rolls 3*a*, 3*b* are an upper work roll 3*a* and a lower work roll 3*b*. The backup rolls 4*a*, 4*b* are an upper backup roll 4*a* and a lower backup roll 4*b*. Oil bearings may be used as bearings for rotating the backup rolls 4*a*, 4*b*. The screw down means 5 is a screw down device for acting the rolling force on the rolled material 1. The rolling force detecting means 6 is an apparatus for detecting the rolling force.

The roll rotation amount detector 7 detects a roll rotation amount. The roll rotation amount here corresponds to number of times a roll is rotated. The roll rotation amount detector 7 may be a counter in which "1" is added each time the roll is rotated once. Incidentally, if the roll rotation amount detector 7 is a sensor for measuring roll rotation speed (i.e. a roll rotation amount per unit time), the number of times the roll is rotated at a constant time may be calculated by multiplying time length to the roll rotation speed.

The roll reference position detector 8 detects a predetermined reference position each time the backup rolls 4*a*, 4*b* are rotated once. The roll gap detector 9 detects a gap between the work rolls 3*a*, 3*b*, i.e. a roll gap.

The upper roll set consists of the upper work roll 3*a* and the upper backup roll 4*a*. On the other hand, the lower roll set consists of the lower work roll 3*b* and the lower backup roll 4*b*.

In the first embodiment, as an example, the case of a 4Hi mill will now be described. The 4Hi mill consists of four rolls of two upper/lower work rolls 3*a*, 3*b* and two upper/lower backup rolls 4*a*, 4*b*. However, it is not limited to this configuration, and another mill called 2Hi mill may be used. The 2Hi mill consists of only two rolls of top/bottom work rolls. Alternatively, another mill called 6Hi mill may be used. The 6Hi mill consists of six rolls: two upper/lower work rolls, two upper/lower intermediate rolls, and two upper/lower backup rolls. Alternatively, another mill having more rolls may be used.

The rolled material 1 is rolled by the work rolls 3*a*, 3*b* whose roll gaps and speeds are appropriately adjusted so as to have a desired strip thickness at the delivery side. The upper work roll 3*a* is supported from above by the upper backup roll 4*a*. The lower work roll 3*b* is supported from below by the lower backup roll 4*b*. Thus, the deflection in the roll width direction is reduced. The backup rolls 4*a*, 4*b* are rotatably supported with respect to the rolling mill housing 2. Each backup roll 4*a*, 4*b* has a structure capable of sufficiently withstanding the rolling force which acts on the rolled material 1.

The screw down means 5 adjusts the gap between the work rolls 3*a*, 3*b*, i.e. the roll gap. The screw down means 5 may be an electric screw down device for electric motor control or a hydraulic pressure screw down device for hydraulic control. Since the hydraulic pressure screw down has an advantage of easily acquiring a high-speed response, the screw down means 5 may be the hydraulic pressure screw down device.

In order to execute control in response to a wave component in a short period such as disturbance due to roll eccentricity, it is generally preferable to use the hydraulic pressure screw down capable of high-speed response. However, as a modification, the screw down means 5 may be the electric pressure screw down device. Since the high speed response in the screw down means is not relevant to roll state monitoring, the roll state monitor device 20 may be applied to a rolling stand which does not have the hydraulic screw down.

The rolling force detecting means 6 detects the rolling force, for example. One exemplary method of detecting rolling force may be a method of directly measuring the rolling force by a load cell embedded between the rolling mill housing 2 and the screw down means 5. Another example of a detection method of rolling force may be a method of calculating the rolling force from pressure detected by the hydraulic screw down means. The rolling force detecting means 6 may be, for example, a load sensor or a pressure sensor, specifically, a strain gauge or a load cell or a hydraulic sensor.

The roll rotation amount detector 7 detects a rotation amount of each work roll 3*a*, 3*b* or the like. The roll rotation amount detector 7 may be provided with the work rolls 3*a*, 3*b*. The roll rotation amount detector 7 may be provided on a shaft (not shown) of an electric motor for driving the work rolls 3*a*, 3*b*.

The roll rotation amount detector 7 may include, for example, pulse output means for outputting a pulse corresponding to a rotation angle of each work roll 3*a*, 3*b*, and angle calculating means for calculating the rotation angle of each work roll 3*a*, 3*b* by detecting the pulse outputted from the pulse output means. The roll rotation amount detector 7 may be configured to be able to finely detect the roll rotation amount and the rotation angle of each work roll 3*a*, 3*b* by using the pulse output means and the angle calculating means.

Incidentally, when a ratio of each diameter of the work rolls 3*a*, 3*b* and each diameter of the backup roll 4*a*, 4*b* is known, the rotational amounts and the rotational angles of the backup rolls 4*a*, 4*b* may be calculated. Specifically, the rotation amounts and the rotation angles of the backup rolls 4*a*, 4*b* may be calculated based on the rotation amounts and the rotation angles of the work rolls 3*a*, 3*b* detected by the roll rotation amount detector 7 in the case where there is no slip between the work rolls 3*a*, 3*b* and the backup rolls 4*a*, 4*b*.

The roll reference position detector 8 detects a reference position in such a manner that a sensor such as a proximity switch detects an object provided on each backup roll 4*a*, 4*b* each time each backup roll 4*a*, 4*b* is rotated, for example. The roll reference position detector 8 may detect the reference position by using a pulse generator in such a manner that a pulse depending on the rotation angle of each backup roll 4*a*, 4*b* is taken out to detect the rotation angle of each backup roll 4*a*, 4*b*, for example.

Incidentally, FIG. 2 illustrates a case where only the roll reference position detector 8 is provided on the upper back-up roll 4*a*. However, as a modification, the roll reference position detector 8 may be provided on each backup roll 4*a*, 4*b*, and each reference position of the backup rolls 4*a*, 4*b* may be detected individually.

The roll gap detector 9 is provided between the backup roll 4*a* and the screw down means 5, as an example. The roll gap detector 9 indirectly detects the roll gap formed between the work rolls 3*a*, 3*b*.

As shown in FIG. 2, the roll state monitor device 20 according to the first embodiment includes a rolling force vertical distribution part 10, a rolling force variation extracting part 11, a roll eccentricity amount identify part 12, a roll eccentricity amount recording part 13, and a roll state determination part 14. The roll state monitor device 20 determines the state of the monitored roll. In the first embodiment, as an example, each of the backup rolls 4*a*, 4*b* is the monitored roll.

The rolling force detecting means 6 detects the rolling force for a plurality of rotation positions of the work rolls 3*a*, 3*b* and the backup rolls 4*a*, 4*b* as described later in FIGS. 3 and 4. The rolling force vertical distribution part 10 distributes the rolling force detected by the rolling force detecting means 6 to an upper side and a lower side based on a ratio of upper rolling force and lower rolling force. A distribution ratio is preset. The upper rolling force is rolling force which is given from the rolled material 1 to the upper roll set having the upper work roll 3*a* and the upper backup roll 4*a*. The lower rolling force is rolling force which is given from the rolled material 1 to the lower roll set having the lower work roll 3*b* and the lower backup roll 4*b*. Incidentally, the upper rolling force and the lower rolling force may be distributed in a ratio of 1:1, for example. However, in fact, the lower rolling force also includes weight of the upper work roll and the upper backup roll. As a result, as actual force, the lower rolling force is slightly larger than the upper rolling force. Total roll weight of the work roll and the backup roll is 30 to 40 tons, while the rolling force is several hundred to two thousand tons or three thousand tons. Therefore, the lower rolling force is slightly larger than the upper rolling force in a ratio therebetween, when considering the roll weight.

The rolling force variation extracting part 11 extracts an upper rolling force variation value $\Delta P_{Tj}$ and a lower rolling force variation value $\Delta P_{Bj}$ based on each rolling force of the upper roll set and the lower roll set which is distributed vertically by the rolling force vertical distribution part 10. The subscript j is j=0, 1, 2 . . . n−1. The upper rolling force variation value $\Delta P_{Tj}$ and the lower rolling force variation value $\Delta P_{Bj}$ are variation values that occur in relation to rotation positions of the upper roll set and the lower roll set.

The roll eccentricity amount identify part 12 makes conversion into a roll gap equivalent value ΔS from each of upper and lower variation components ΔP of each rolling force separately extracted by the rolling force variation extracting part 11. The roll eccentricity amount identify part 12 adds the converted roll gap equivalent value ΔS by a plurality of adders 121*d* to 122*d* which are described later in FIG. 5. The reason for performing conversion into the roll gap equivalent value ΔS is to prevent undesirable variation in the rolling force variation value caused by the difference in characteristics of the rolled material (e.g., hardness of the rolled material). This is because, for example, rolling force fluctuation tends to increase in hard material.

In the rolling mill 50, the roll gap equivalent value ΔS is used to actually adjust the roll gap, and thereby the strip thickness variation of the rolled material 1 can be reduced. However, the roll state monitor device 20 in the first embodiment is not provided with a function of adjusting the roll gap for reducing influence on the strip thickness variation due to roll eccentricity. This results in that, in the first embodiment, the adders 121*d*, 122*d* continuously add data throughout rolling process, and each data in the adders 121*d*, 122*d* continues to increase as the roll rotation amount increases. Therefore, in the first embodiment, each output value from the adders 121*d*, 122*d* is corrected by dividing the output values by a correction coefficient corresponding to the roll rotation amount in order to determine the roll eccentricity amount.

The roll eccentricity amount recording part 13 records a plurality of output values $y_{Tj}$, $y_{Bj}$ outputted from the roll eccentricity amount identify part 12. The subscript j is j=0, 1, 2 . . . n−1. Each of the output values $y_{Tj}$, $y_{Bj}$ is an identified value of the roll eccentricity amount.

A roll eccentricity amount peak-to-peak value $\Delta y_{peak}$ is calculated from recorded data in the roll eccentricity amount recording part 13. The roll eccentricity peak-to-peak value $\Delta y_{peak}$ is difference between a maximum value and a minimum value among the roll eccentricity amounts identified by the roll eccentricity amount identification part 12.

The roll eccentricity amount recording part 13 records the roll eccentricity amount peak-to-peak value $\Delta y_{peak}$ identified by the roll eccentricity amount identification part 12 during a predetermined rolling period which is set in advance, as a "normal roll eccentricity amount peak-to-peak value $\Delta y_{nor_peak}$". The normal roll eccentricity peak-to-peak value $\Delta y_{nor_peak}$ is a determination value which represents the roll eccentricity peak-to-peak value $\Delta y_{peak}$ when the monitored roll is normal.

Incidentally, the "predetermined rolling period" described above may be a period from immediately after roll replacement to the elapse of a predetermined time which is set in advance, or may be a period required for rolling a predetermined number of the rolled material 1 immediately after the roll replacement. Every time rolling process of the rolled material 1 is completed, each roll eccentricity amount peak-to-peak value $\Delta y_{peak}$ of each rolled material 1 is calculated. Each calculated roll eccentricity amount peak-to-peak value $\Delta y_{peak}$ is recorded as the roll eccentricity amount peak-to-peak value $\Delta y_{peak}$ at a time when rolling process of each rolled material 1 is completed.

The roll eccentricity amount recording part 13 may be modified so that the roll eccentricity amount peak-to-peak value $\Delta y_{peak}$ is replaced with a roll eccentricity amount maximum value $y_{max}$ (i.e. a peak value of positive side) or a roll eccentricity amount minimum value $y_{min}$ (i.e. a peak value of negative side). In this modification, the roll eccentricity amount recording part 13 may record each of the roll eccentricity amount maximum value $y_{max}$ or the roll eccentricity amount minimum value $y_{min}$. In this case, the roll eccentricity amount recording part 13 records the roll eccentricity amount maximum value $y_{max}$ or the roll eccentricity amount minimum value $y_{min}$ identified by the roll eccentricity amount identify part 12 during a predetermined rolling period which is set in advance, as the roll eccentricity amount maximum value $y_{max}$ or the roll eccentricity amount minimum value $y_{min}$ when the monitored roll is normal. The roll eccentricity maximum value $y_{max}$ in a normal state of the roll is also referred to as a "normal roll eccentricity maximum value $y_{nor_max}$". The roll eccentricity minimum value $y_{min}$ in a normal state of the roll is also referred to as a "normal roll eccentricity minimum value $y_{nor_min}$."

It should be noted that the time period described above is a time period from immediately after the roll replacement to the elapse of a certain time, or a time period from immediately after the roll replacement to the completion of rolling process of a certain number of rolled materials, and each time period is set as a time period necessary for rolling the "predetermined number" of rolled materials. The predetermined number is preferably set to a somewhat large number such as 5 or 10. The values of 5 or 10 will now be described. The work roll is periodically replaced when about one hundred of the rolled materials 1 has been rolled. If the predetermined number described above is set to 40 to 50, a very few number of the rolled materials 1 are used to determine whether normal or abnormal, and this is not practical. Therefore, the predetermined number described above, for example, may be preferably set about 10 pieces which is within 10% of 100 pieces. In addition, a replacement cycle of the backup roll is several days to ten days. Thousands of the rolled materials 1 will be rolled during this period. Therefore, when the backup roll is set as the monitored roll, the predetermined number can be set more than 5 to 10. The work roll directly contacts the rolled material, and this causes near the center part in the width direction to be easily worn, resulting in that it is necessary to frequently replace and polish the roll. Therefore, the work roll is replaced in the above cycle. On the other hand, since the backup roll does not directly contact the rolled material, replacement cycle thereof may be set long. Further, there may be a premise that the roll is normal immediately after roll polishing. This is because an abnormality can be easily found when a person looks at the roll in the polishing process.

The roll state determination part 14 determines each state of the backup rolls 4*a*, 4*b* which are monitored rolls by using the recorded data in the roll eccentricity amount recording part 13.

In the first embodiment, as an example, the roll state determining part 14 may perform a comparison determination based on the data recorded in a predetermined time after roll replacement. This comparison determination is achieved in a routine of FIG. 6 described later. Further, the roll state determination part 14 according to another modification may determine normal/abnormal of the roll state based on a fixed value or a statistical value determined from the data acquired in the past, rather than based on the data recorded in the predetermined time after the roll replacement. This modification is achieved in a routine of FIG. 7 described later. Specific method of determination in the roll state determination part 14 will be described later with reference to FIGS. 6 and 7.

Next, with reference to FIGS. 3 to 8, operation of the roll state monitor device 20 according to the first embodiment will be specifically described.

Figure 3:
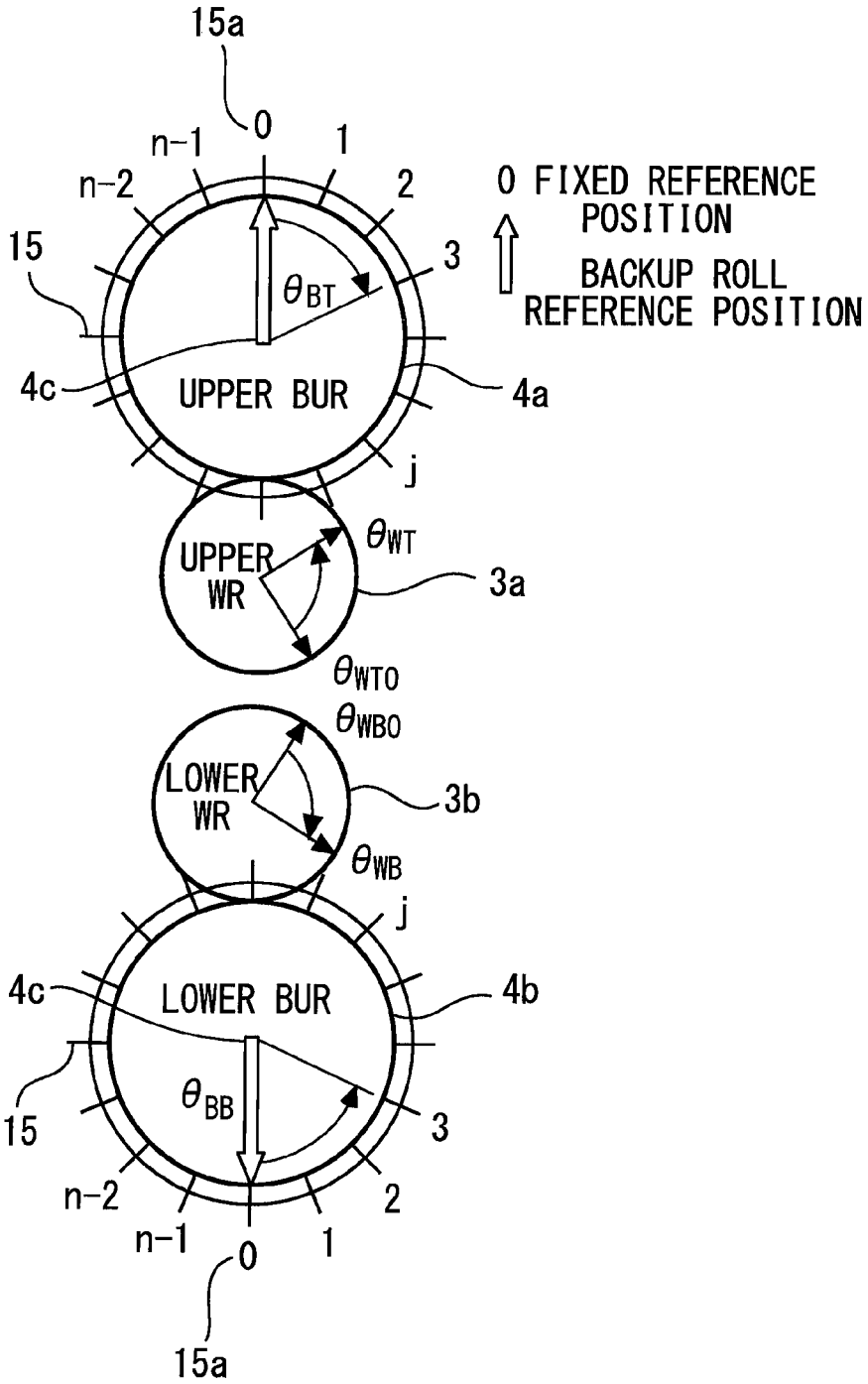
FIG. 3 is a diagram for explaining relationship between a work roll and a division manner of a backup roll according to the first embodiment.
Figure 4:
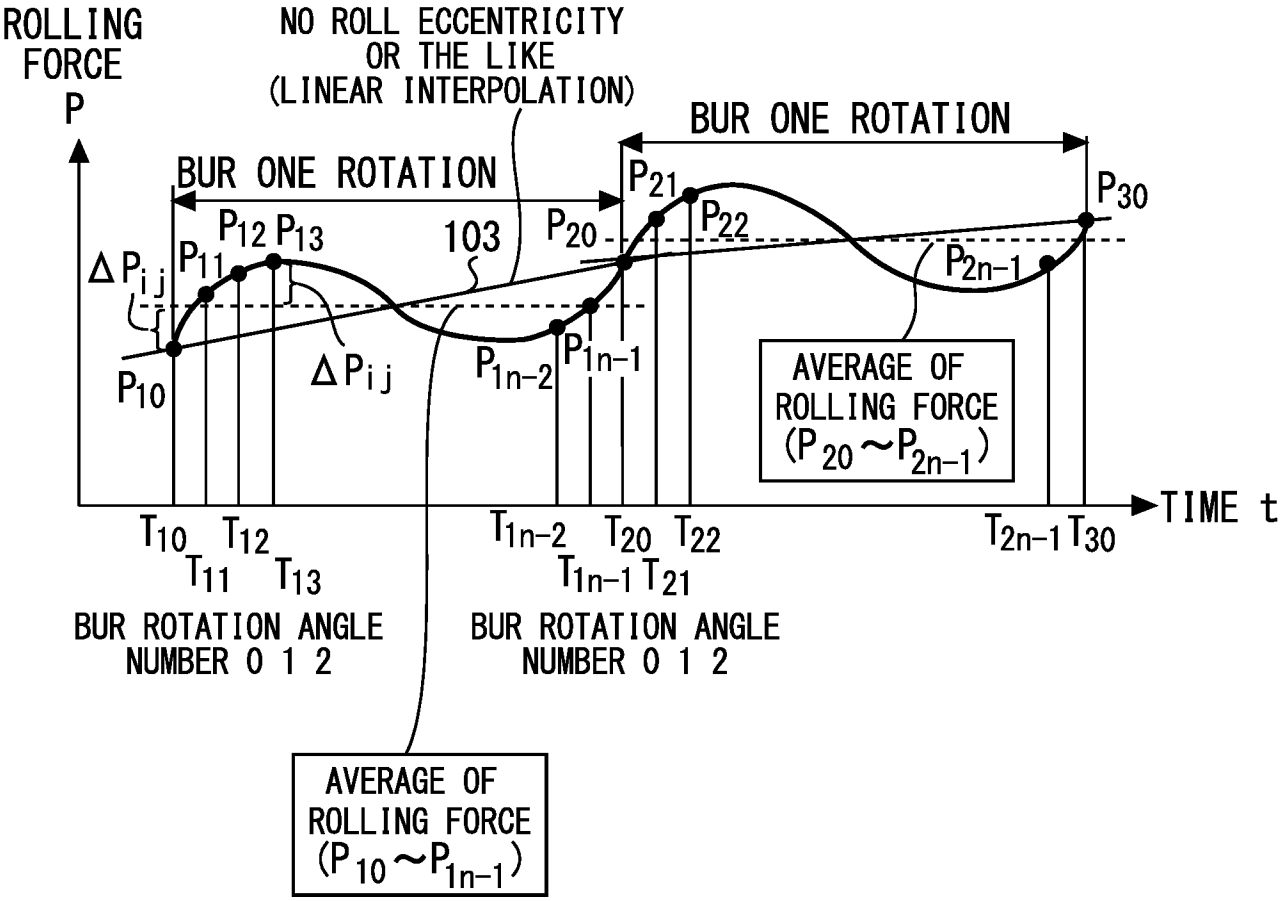
FIG. 4 is a diagram illustrating a state of variation of rolling force according to the first embodiment.

First, with reference to FIGS. 3 and 4, each configuration and operation of the rolling force vertical distribution part 10 and the rolling force variation extracting part 11 is specifically described. FIG. 3 is a diagram for explaining the relation between the work rolls 3*a*, 3*b* and division of the backup rolls 4*a*, 4*b* according to the first embodiment. FIG. 3 illustrates positional relationships between the work rolls 3*a*, 3*b* and the backup rolls 4*a*, 4*b*. It should be noted that the backup roll may be abbreviated as "BUR", the work roll may be abbreviated as "WR".

As shown in FIG. 3, each of the backup rolls 4*a*, 4*b* has a position scale 15 for detecting the rotation position. Further, it is also illustrated that a reference position 4*c* is preset in part of each backup roll 4*a*, 4*b* and the reference position 4*c* rotates in conjunction with the rotation of each backup roll 4*a*, 4*b*. The position scale 15 is provided on each immediate outer side of the backup rolls 4*a*, 4*b* so as to surround each periphery of the backup rolls 4*a*, 4*b*, for example. The scale is provided to divide each entire circumference of the backup rolls 4*a*, 4*b* into 1st to nth portions equally. That is, the scale is provided for each predetermined angle (i.e. each 360/n degrees) around each rotational axis of the backup rolls 4*a*, 4*b*. Then, a reference position 15*a* (a fixed reference position) of the positional scale 15 is set to be "0", and other positions are numbered from $1^{st}$ up to $(n-1)^{th}$. Incidentally, the "n" is set to be a value of about n=30 to 90, for example. Here, the position scale 15 is provided for explaining the rolling force variation extracting part 11 or the like, and the scale itself may be omitted in actual equipment.

Here, $\theta_{WT0}$ is a rotational angle of the work roll 3 when each reference position 4*c* of the backup rolls 4*a*, 4*b* matches the fixed reference position 15*a*. The $\theta_{WT}$ is a rotation angle of the work roll 3 after each of the backup rolls 4*a*, 4*b* is rotated by $\theta_{BT}$. Here, θ represents an angle, a subscript W represents the work roll 3, a subscript B represents the backup roll 4, a subscript T represents the upper roll, and a subscript B represents the lower roll.

In the following, each rotation angle of the backup rolls 4*a*, 4*b* is assumed to represent an angle at which each reference position 4*c* of the backup rolls 4*a*, 4*b* moves in conjunction with each rotation of the backup rolls 4*a*, 4*b* from the fixed reference position 15*a*. For example, if each rotation angle of the backup rolls 4*a*, 4*b* is 90 degrees, each reference position 4*c* of the backup rolls 4*a*, 4*b* is at a position rotated 90 degrees from the fixed reference position 15*a* in each rotational direction of the backup rolls 4*a*, 4*b*. Further, it is assumed that, when each rotation angle of the backup rolls 4*a*, 4*b* is closest to a scale (e.g., a $j^{th}$ scale) of the position scale 15, "j" is each rotation angle number of the backup rolls 4*a*, 4*b*.

Incidentally, a sensor such as a proximity sensor and an object to be detected by the sensor may be embedded at each reference position 4*c* and each fixed reference position 15*a* of the backup rolls 4*a*, 4*b*, and thereby the roll reference position detector 8 is configured of the sensor and the object. In such a case, for example, the proximity sensor provided at each reference position 4*c* of the backup rolls 4*a*, 4*b* is rotated with the backup roll 4 and reaches the fixed reference position 15*a*, and thereby the proximity sensor detects the object which is embedded in the reference position 15*a*. That is, it is recognized that each reference position 4*c* of the backup rolls 4*a*, 4*b* has passed through the fixed reference position 15*a*. Incidentally, the roll reference position detector 8 is not essential to the first embodiment.

Each division position from the fixed reference position $0^{th}$ to the position $n-1^{th}$ is individually associated with each division of rolling force recording areas ($P_0$~$P_{n-1}$ in FIG. 5) in FIG. 5 to be described later, and each rolling force at these division positions is stored in each recording area. Typically, a value n=30 to 90 or near can be used. To set the value n as a large value, a controller preferably has sufficiently high degree of arithmetic processing capability, and therefore it is preferable to pay attention to contradiction relationship between fineness and arithmetic ability of control.

Hereinafter, a backup roll rotation angle is assumed to represent an angle at which a backup roll reference position moves in conjunction with each rotation of the backup rolls 4*a*, 4*b* from a fixed reference position. For example, if the backup roll rotation angle is 90 degrees, a backup roll reference position is at a position rotated 90 degrees from a fixed reference position in each rotational direction of the backup rolls 4*a*, 4*b*. Further, it is assumed that, when the backup roll rotation angle is closest to one scale (e.g., an $i^{th}$ scale) of the position scale, "i" is a backup roll rotation angle number.

FIG. 4 is a diagram illustrating a state of variation of the rolling force according to the first embodiment. Description will now be made about a method to extract variation component in rolling force caused by roll eccentricity, with reference to FIG. 4.

FIG. 4 illustrates variation of the rolling force with change in the backup roll rotation angle. In FIG. 4, the rolling force corresponds to P10 at the time $T_{10}$ when the reference position 4*c* of the backup roll 4 is at the reference position 15*a*, i.e., when the rotation angle number of the backup roll 4 is "0". As the rotation angle number of the backup roll 4 advances 1, 2, 3 . . . and the time advances to $T_{11}$, $T_{12}$, $T_{13}$ . . . , the rolling force changes as P11, P12, P13 . . . . Then, the backup roll 4 is rotated one revolution, the rotation angle number becomes 0 again from (n−1).

If a straight line 103 is drawn to connect points of the rolling force $P_{10}$, $P_{20}$ when rolling force $P_{20}$ is taken, the straight line 103 may be regarded as rolling force in which the rolling force variation due to roll eccentricity is excluded. Therefore, the rolling force variation due to roll eccentricity may be determined from each difference between the straight line 103 and each rolling force $P_{11}$, $P_{12}$, $P_{13}$ . . . $P_{20}$ measured at each corresponding rotational angle number.

Incidentally, each value of rolling force $P_{ij}$ actually measured (i.e. an actual value) often includes noise components in addition to the rolling force variation due to the roll eccentricity and rolling force variation due to temperature variation, strip thickness variation, or tension variation, etc. Therefore, each actual value of the rolling force $P_{ij}$ is not distributed on a smooth curve as shown in FIG. 4, and therefore it may be difficult to identify the rolling force $P_{i0}$ of a starting point and the rolling force $P_{(i+1)0}$ of an end point for acquiring the above straight line drawn therebetween.

Therefore, the following calculation may also be performed based on an average value. First, it is assumed that difference between the rolling force $P_{i0}$ and the rolling force $P_{(i+1)0}$ is not large. Then, a difference amount $\Delta P_{ij}$ between each measured rolling force $P_{i0}$, $P_{i1}$, $P_{i2}$, $P_{i3}$ . . . $P_{(i+1)0}$ and an average value $\Delta P_{AVE_n}$ may be regarded as the variation component of the rolling force caused by the roll eccentricity. The average value $\Delta P_{AVE_n}$ is an average value of n values of the rolling force $P_{i0}$, $P_{i1}$, $P_{i2}$, $P_{i3}$, . . . $P_{i(n-1)}$.

This calculation method based on the average value is advantageous because collection of actual values of each rolling force can be finished at the (n−1) division, and because it is also resistant to the variation of the rolling force due to noise, etc. It is noted that the actual value of the rolling force may be filtered to reduce noise components, which is an additional effective measure.

Figure 5:
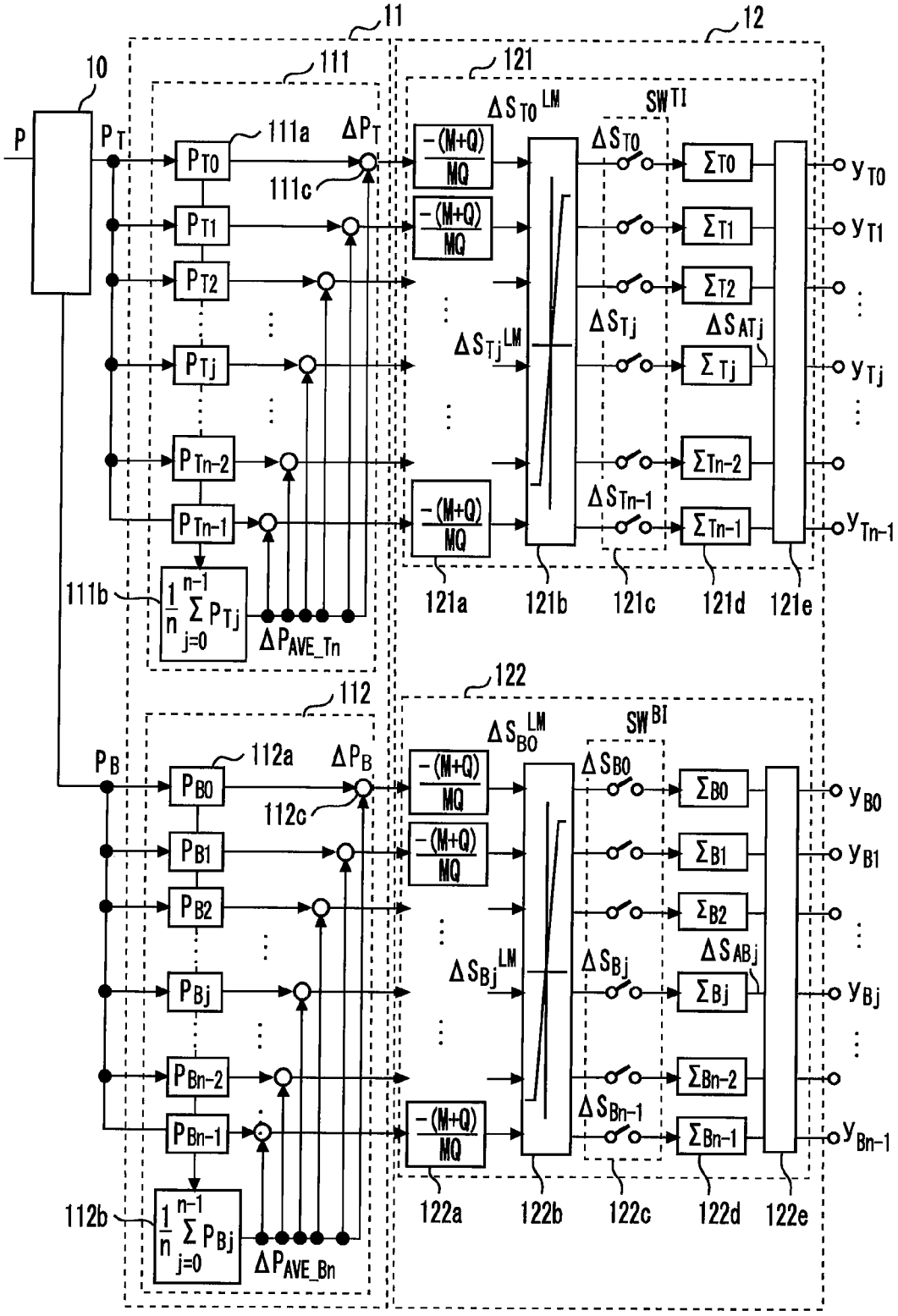
FIG. 5 is a diagram for specifically explaining an extraction method of the rolling force variation and an identification method of a roll eccentricity amount according to the first embodiment, and device configuration thereof.

FIG. 5 is a diagram for specifically explaining an extraction method of the rolling force variation and an identification method of a roll eccentricity amount according to the first embodiment, and device configuration thereof. With reference to FIG. 5, specific configuration and operation of the rolling force variation extracting part 11 and the roll eccentricity amount identify part 12 will now be described. As shown in FIG. 5, the rolling force variation extracting part 11 includes an upper rolling force variation extracting part 111 and a lower rolling force variation extracting part 112.

The upper rolling force variation extracting part 111 extracts each upper rolling force variation value $\Delta P_T$ based on each rolling force $P_T$ distributed by the rolling force vertical distribution part 10. Each upper rolling force variation value $\Delta P_T$ is each value acquired by extracting each variation component in each rolling force $P_{Tj}$ caused by the roll eccentricity at each rotation position of the upper backup roll 4*a*. Each upper rolling force variation $\Delta P_{T0}$, $\Delta P_{T1}$ . . . $\Delta P_{Tn-1}$ is calculated for each rotation position of the upper backup roll 4*a*.

The lower rolling force variation extracting part 112 extracts each lower rolling force variation $\Delta P_B$ based on each rolling force $P_B$ distributed by the rolling force vertical distribution part 10. Each lower rolling force variation value $\Delta P_B$ is each value acquired by extracting each variation component of each rolling force $P_{Bj}$ caused by the roll eccentricity at each rotation position of the lower backup roll 4*b*. Each lower rolling force variation $\Delta P_{B0}$, $\Delta P_{B1}$ . . . $\Delta P_{Bn-1}$ is calculated for each rotation position of the lower backup roll 4*b*.

Further, the upper rolling force variation extracting part 111 includes a rolling force recording part 111*a*, average value calculating means 111*b*, and variation calculating means 111*c*. Similarly, the lower rolling force variation extracting part 112 also includes a rolling force recording part 112*a*, average value calculating means 112*b*, and variation calculating means 112*c*.

Each of the rolling force recording parts 111*a*, 112*a* has rolling force recording units provided corresponding to each rotation angle number of the backup rolls 4*a*, 4*b*, and the number of the rolling force recording units is "n". Each of the rolling force recording parts 111*a*, 112*a* records for a predetermined period each rolling force $P_{Tj}$, $P_{Bj}$ when each angle of the backup rolls 4*a*, 4*b* reaches corresponding rotation angle number.

The average value calculation part 111*b* calculates the average value $\Delta P_{AVE_Tn}$ based on each rolling force $P_{Tj}$ recorded in the rolling force recording part 111*a*. The average value $\Delta P_{AVE_Bn}$ is an average of n values of rolling force $P_{Tj}$ detected during the upper backup roll 4*a* is rotated once (j=0 to (n−1)).

The average value calculation part 112*b* calculates the average value $\Delta P_{AVE_Bn}$ based on each rolling force $P_{Bj}$ recorded in the rolling force recording part 112*a*. The average value $\Delta P_{AVE_Bn}$ is an average of n values of rolling force $P_{Bj}$ detected during the lower backup roll 4*b* is rotated once (j=0 to (n−1)).

Each variation calculating means 111*c* is provided so as to correspond to each rolling force recording part 111*a* in one-to-one manner. Each variation calculating means 111*c* calculates and outputs each variation value $\Delta P_{Tj}$ every time the backup roll 4*a* is rotated once. Each variation value $\Delta P_{Tj}$ is a deviation amount of each rolling force $P_{Tj}$ from the average value $\Delta P_{AVE_Tn}$. Each rolling force $P_{Tj}$ is recorded in one corresponding unit of the rolling force recording part 111*a*. Each variation calculating means 112*c* in the lower rolling force variation extracting part 112 also outputs each variation value $\Delta P_{Bj}$ by performing the same operation process.

The roll eccentricity amount identify part 12 includes upper adding means 121 and lower adding means 122.

The upper adding means 121 includes conversion blocks 121*a*, a limiter 121*b*, switches 121*c*, adders 121*d*, and a rotational speed correction block 121*e*. The upper addition means 121 converts each variation component in each rolling force $P_{Tj}$ outputted from the upper rolling force variation extracting part 111 due to roll eccentricity into each roll gap equivalent value $\Delta S_{Tj}$ by each conversion block 121*a*. Each converted roll gap equivalent value $\Delta S_{Tj}$ goes through the limiter 121*b* and each switch 121*c*, and is independently accumulated in each of a plurality of the adders 121*d* for each rotational angle number.

The lower adding means 122 includes conversion blocks 122*a*, a limiter 122*b*, switches 122*c*, adders 122*d*, and a rotational speed correction block 122*e*. The lower adding means 122 converts each variation component in each rolling force $P_{Bj}$ outputted from the lower rolling force variation extracting part 112 due to roll eccentricity into each roll gap equivalent value $\Delta S_{Bj}$. Each converted roll gap equivalent value $\Delta S_{Bj}$ goes through the limiter 122*b* and each switch 122*c*, and is independently accumulated in each of a plurality of the adders 122*d* for each rotation angle number.

In FIG. 5, for distinction, a roll gap equivalent value inputted to the limiter 121*b* is described as particularly $\Delta S_{Tj}^{LM}$, and a roll gap equivalent value outputted from the limiter 121*b* is described as $\Delta S_{Tj}$. Similarly, a roll gap equivalent value inputted to the limiter 122*b* is described as particularly $\Delta S_{Bj}^{LM}$, and a roll gap equivalent value outputted from the limiter 122*b* is described as $\Delta S_{Bj}$. However, the limiters 121*b*, 122*b* may be omitted in a modification of the first embodiment, and when these components are omitted, it is not necessary to distinguish the roll gap equivalent values before and after the limiter.

Incidentally, the upper adding means 121 and the lower adding means 122 have the same configuration. Therefore, the following description mainly refers to operation of the upper adding means 121, and the description of the lower adding means 122 is omitted or simplified as necessary.

In the upper adding means 121, first, the conversion block 121*a* corresponding to the $j^{th}$ rotation position converts the force variation value $\Delta P_{Tj}$ to the roll gap equivalent value $\Delta S_{Tj}$. Calculation processing in the conversion block 121*a* can be achieved based on the following equation (3). Load variation ΔP and roll gap equivalent ΔS in the equation (3) are assumed to be $\Delta P_{Tj}$ and $\Delta S_{Tj}$, respectively. In the equation (3), "M" is a mill constant, "Q" is a plastic coefficient of the rolled material. These parameters are generally calculated in setting calculation process before sheet passing of each rolled material.

[Expression 1]

$$\Delta S = \frac{-(M+Q)}{MQ}\Delta P \tag{3}$$

Using the above equation (3), the reason for converting the rolling force variation value ΔP to the roll gap equivalent value ΔS will now be described below. Different steel grades may also cause different rolling force variation values. For example, ΔP of hard steel grades is large, while ΔP of soft steel grades is small. It is assumed that the normal roll eccentricity amount peak-to-peak value $\Delta y_{nor_peak}$ is calculated based on values measured upon rolling a soft steel grade material after roll replacement, and thereafter a large value of ΔP is detected upon rolling a hard grade material. In this case, depending on setting of a threshold value, there is a possibility that the roll is determined to be abnormal when performing rolling of the hard grade material.

In this regard, since the roll gap equivalent value is used in the above equation (3), a substantially constant value is calculated regardless of a soft material or a hard material if a roll state is normal. Therefore, it is possible to accurately determine whether or not the roll state is normal. Incidentally, the conversion block 122*a* of the lower adding means 122 calculates the $\Delta S_B$ by performing operation processing according to the equation (3) similarly to the conversion block 121*a*.

The limiter 121*b* of the upper adding means 121 checks each of the upper and lower limits of a plurality of roll gap equivalent values $\Delta S_{Tj}$ (j=0, 1, . . . n−1) inputted from the plurality of variation calculating means 111*c*. The limiter 122*b* of the lower adding means 122 checks the respective upper and lower limits of a plurality of roll gap equivalent values $\Delta S_{Bj}$ (j=0, 1, . . . n−1) similarly to the limiter 121*b*. Each of the limiter 121*b* and the limiter 122*b* restricts each of the roll gap equivalent values $\Delta S_{Tj}$ and $\Delta S_{Bj}$ within a predetermined range. Incidentally, the limiters 121*b*, 122*b* are provided to detect the abnormality of the roll. When upper and lower limit values are set to have an excessive narrow width therebetween in each of the limiters 121*b*, 122*b*, abnormality may not be detected. The width between the upper and lower limit values in each limiter 121*b*, 122*b* is preferably not set too narrow. These limiters 121*b*, 122*b* are provided to avoid influence of steep and large noise. Here, the width between the upper and lower limit values in each limiter 121*b*, 122*b* also referred to as a "limiter width", for convenience. Hereinafter, an example of a setting method of the limiter width will now be described. A coefficient "m" is used in determination process in step S1403 in a flowchart of FIG. 6 described later. The coefficient m is a coefficient for abnormal determination in step S1403 of FIG. 6. The limiter width may be determined in relation to the coefficient "m". A comparison determination value for abnormal determination is acquired by multiplying the value of "m" by each value of the normal roll eccentricity amount, the maximum roll eccentricity amount or the minimum roll eccentricity amount. When m=2 is set as an example for abnormality determination, it becomes meaningless to set a value smaller than at least the "twice" in the limiter. Here, m=2 provides a value by multiplying by m times each of the normal roll eccentricity amount and the maximum/minimum roll eccentricity amount. Therefore, it is preferable that the normal roll eccentricity is measured or assumed in advance for the limiter, and a value equals to or larger than the (2 m) times value thereof may be set as the upper and lower limit values. This can suppress that a limiter width becomes too narrow.

There are n unit switches $SW^{TI}$ in the switches 121*c*, and each switch $SW^{TI}$ corresponds to each rotational angle number in the upper backup roll 4*a*. Every time the upper backup roll 4*a* is rotated once (i.e., each time the calculation of the average value in the average value calculating part 111*b* is completed), each of n unit switches in the switch 121*c* turns on in the order of the rotation angle numbers. Each switch 121*c* outputs each roll gap equivalent value $\Delta S_{T0} \ldots \Delta S_{Tn-1}$ having passed through the limiter 121*b* to each adder 121*d* at the subsequent stage.

There are also n unit switches $SW^{BI}$ in the switches 122*c* of the lower adding means 122, and each unit switch $SW^{BI}$ corresponds to each rotation angle number of the lower backup roll 4*b*. Each switch 122*c* operates in the same manner as the switch 121*c*, the roll gap equivalent values $\Delta S_{B0} \ldots \Delta SB_{n-1}$, are outputted to the adders 122*d* of the subsequent stage.

There are n unit adders $\Sigma_{T0}, \Sigma_{T1} \ldots \Sigma_{Tj} \ldots \Sigma_{Tn-1}$ in the adders 121*d*, and each unit adder $\Sigma_{T0}, \Sigma_{T1}, \ldots \Sigma_{Tj} \ldots \Sigma_{Tn-1}$ is provided for each rotational angle number of the upper backup roll 4*a*. Each of the n unit adders $\Sigma_{T0}, \Sigma_{T1} \ldots \Sigma_{Tn-1}$ adds each of the roll gap equivalent values $\Delta S_{T0} \ldots \Delta S_{Tn-1}$ independently to calculate a plurality of accumulated values $\Delta S_{ATj}$ (j=0, 1 . . . n−1).

When the upper backup roll 4*a* is rotated ten times as an example, the accumulated value $\Delta S_{AT0}$ in the unit adder $\Sigma_{T0}$ is an accumulated value acquired by summing ten values of the roll gap equivalent value $\Delta S_{T0}$, for example. Similarly thereto, in each adder 122*d* of the lower adding part 122, each of the n unit adders $\Sigma_{B0}, \Sigma_{B1} \ldots \Sigma_{Bj} \ldots \Sigma_{Bn-1}$ accumulates each of the roll gap equivalent values $\Delta S_{B0} \ldots \Delta S_{Bn-1}$ individually, and thereby a plurality of accumulated values $\Delta S_{Bj}$ (j=0, 1 . . . n−1) are calculated.

Incidentally, when rolling process of one rolled material is completed, each of the adders 121*d*, 122*d* may be zero-cleared.

The rotation amount correction block 121*e* has a correction function which prevents the roll eccentricity amount from keeping accumulated. Since the first embodiment does not have rolling force control operation based on the roll eccentricity amount or the like, the roll eccentricity of the actual machine is not suppressed. The rotation amount correction block 121*e* specifically divides each output value from each adder 121*d* by the roll rotation amount. The rotation amount correction block 121*e* outputs this calculation result for n pieces of the roll division number.

The rotational speed correction block 121*e* executes correction calculation of each output value from each adder 121*d* by a correction coefficient corresponding to the roll rotation amount. The correction coefficient is preferably a variable value which is set larger as the number of times the monitored roll is rotated becomes larger in an accumulation period during which a plurality of accumulated values $\Delta S_{ABj}$ (j=0, 1, . . . , n−1) are accumulated. In the first embodiment, although the correction coefficient is the same value as the number of times the monitored roll is rotated, the correction coefficient may be set as a value other than this. As another example, the correction coefficient may be set less or more than the number of times the monitored roll is rotated. For example, the correction coefficient may be a value acquired by subtracting or adding a predetermined value with respect to the number of times the monitored roll is rotated. As further another example, the correction coefficient may be calculated as a variable value directly proportional to rotation amount of the monitored roll by multiplying a proportional coefficient being set in advance by the number of times the monitored roll is rotated.

Incidentally, the rotation amount correction block 122*e* of the lower adding means 122 also executes the same correction operation as the rotation amount correction block 121*e*. Each output value $y_{T0} \ldots y_{Tn-1}$ from the rotation amount correction block 121*e* and each output value $y_{B0} \ldots y_{Bn-1}$ from the rotation amount correction block 122*e* are the roll eccentricity amount acquired by the identification calculation in the roll eccentricity amount identification part 12.

With the above-described mechanism, the upper adding means 121 in FIG. 5 outputs each of the roll eccentricity amounts $y_{T0}, \ldots y_{Tn-1}$ about the upper backup roll 4*a* which is the monitored roll in the upper roll set. The lower adding means 122 in FIG. 5 outputs each of the roll eccentricity amounts $y_{B0}, \ldots y_{Bn-1}$ about the lower backup roll 4*b* which is the monitored roll in the lower roll set.

(Specifically Processing for Roll State Determination)

Next, with reference to FIGS. 6 to 8, operation of the roll eccentricity amount recording part 13 and the roll state determination part 14 will now be described. As shown in FIG. 2, the roll eccentricity amount recording part 13 stores the roll eccentricity amount $y_{Tj}$ of the upper monitored roll (i.e., the upper backup roll 4*a*) and the roll eccentricity amount $y_{Bj}$ of the lower monitored roll (i.e., the lower backup roll 4*b*) transmitted from the roll eccentricity amount identify part 12. The roll state determination part 14 executes roll state determination based on data taken from the roll eccentricity amount recording part 13, according to one of routine of FIG. 6 and routines FIGS. 7 and 8.

Figure 6:
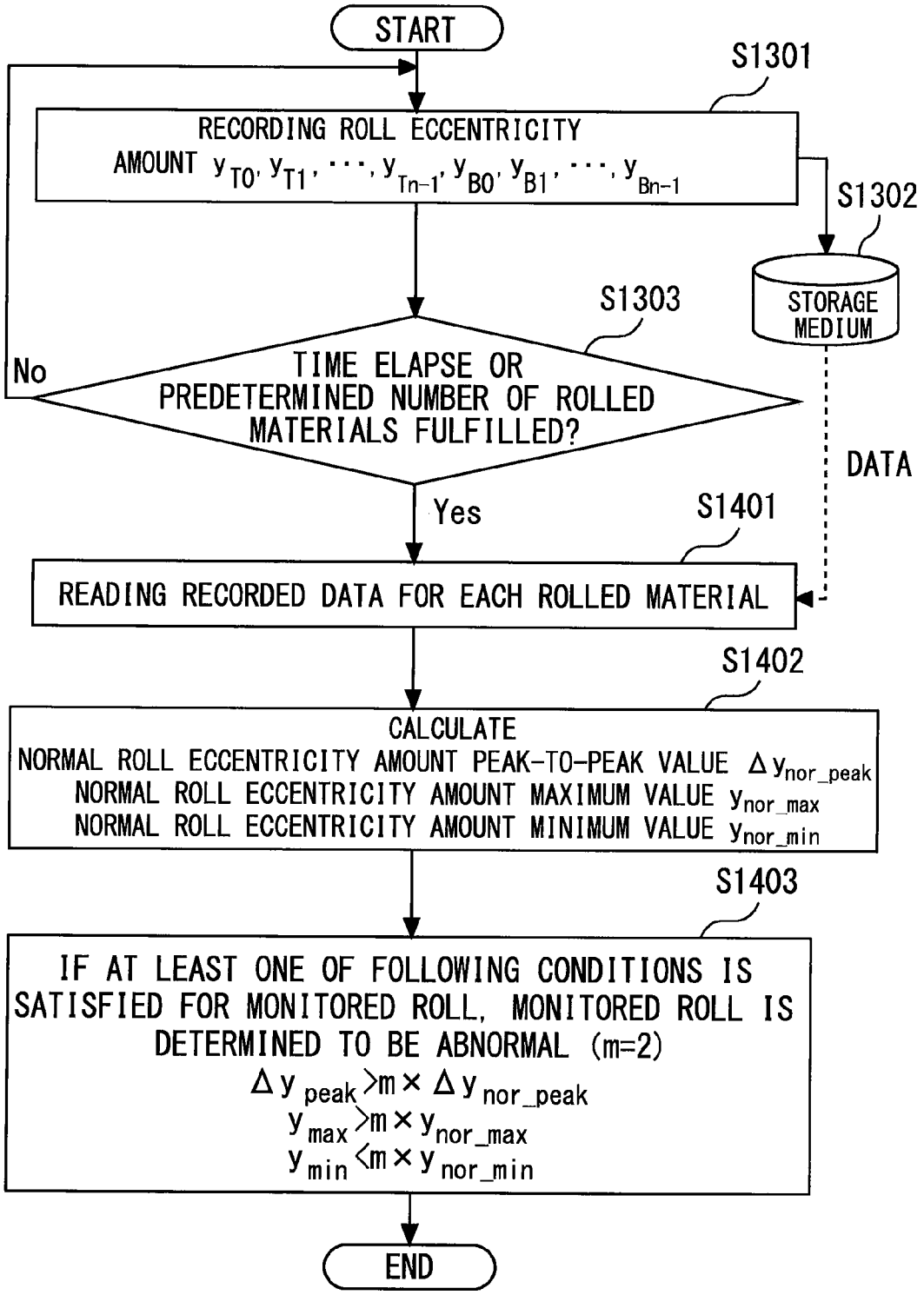
FIG. 6 is a flowchart for explaining a first roll state determination technique according to the first embodiment.

FIG. 6 is a flowchart for explaining a first roll state determination technique according to the first embodiment. The routine of FIG. 6 is executed by the roll eccentricity amount recording part 13 and the roll state determination part 14. FIG. 6 illustrates a method to determine the abnormality of the roll state by the roll eccentricity amount recording part 13 and the roll state determination part 14 after the processing in FIG. 5 identifies the roll eccentricity amount of the rolled material.

The first embodiment provides a first determination method, a second determination method, and a third determination method, as the first roll state determination technique. The first determination method is a method for comparing the roll eccentricity amount peak-to-peak value $\Delta y_{peak}$ in each rolled material with the normal roll eccentricity amount peak-to-peak value $\Delta y_{nor_peak}$. The second determination method is a method to compare the roll eccentricity maximum value $y_{max}$ in each rolled material with the normal roll eccentricity maximum value $y_{nor_max}$. The third determination method is a method to compare the roll eccentricity minimum value $y_{min}$ in each rolled material with the normal roll eccentricity minimum value $y_{nor_min}$.

Either one of the first determination method, the second determination method, and the third determination method may be used. Alternatively, any two of those determination methods may be combined, or all three methods may be used. Three values of the roll eccentricity amount peak-to-peak value $\Delta y_{peak}$, the roll eccentricity amount maximum value $y_{max}$, and the roll eccentricity amount minimum value $y_{min}$ are representative values calculated based on the roll eccentricity amounts $y_{Tj}$, $y_{Bj}$, and therefore these values may be regarded as having determination function equivalent to each other.

In the routine of FIG. 6, first, the roll eccentricity amounts $y_{Tj}$, $y_{Bj}$ are recorded (step S1301). Every time the rolling process of one rolled material 1 is completed, the roll eccentricity amounts $y_{T0}, y_{T1}, \ldots y_{Tn-1}$ and the roll eccentricity amounts $y_{B0}, y_{B1}, \ldots y_{Bn-1}$ identified by the roll eccentricity amount identify part 12 in FIG. 5 are recorded. The recorded data is stored in a recording medium in the roll eccentricity amount recording part 13 (step S1302).

Next, it is determined whether or not a predetermined time has elapsed, or whether a predetermined number of the rolled material 1 is rolled (step S1303). The determination in step S1303 may have only one of a time elapse condition and a condition of predetermined number of rolling process. Alternatively, the determination result in step S1303 may be affirmative when at least one of the time elapse condition and the condition of the predetermined number of rolling process is satisfied. Alternatively, the determination in step S1303 may include both of the time elapse condition and the condition of the predetermined number of rolling process.

Processing in step S1303 is a determination processing for determining time elapse of a "first rolling period". According to the first embodiment, the identification value of the roll eccentricity amount acquired in the first rolling period is used to evaluate validity of the roll eccentricity amount in a second rolling period after the first rolling period.

Next, recorded data for each rolled material is read out (step S1401). In this step, data type being read out is changed in accordance with contents of the following determination process.

Next, the following calculation processing of (a1) to (a3) is performed based on the data read in the above step S1401 (step S1402):

(a1) an average value of the roll eccentricity amount peak value $\Delta y_{peak}$ is calculated, and the calculated average value is set to be the normal roll eccentricity amount peak-to-peak value $\Delta y_{nor_peak}$;

(a2) an average value of the roll eccentricity maximum value $y_{max}$ is calculated, and the calculated average value is set to be the normal roll eccentricity maximum value $y_{nor_max}$; and (a3) an average value of the roll eccentricity amount minimum value $y_{min}$ is calculated, and the calculated average value is set to be the normal roll eccentricity amount minimum value $y_{nor_min}$.

Incidentally, each data processing of (a1) to (a3) described above may be preferably executed for each monitored roll when there are a plurality of monitored rolls. In the first embodiment, processing in step S1402 calculates each representative value $\Delta y_{Tnor_peak}$, $y_{Tnor_max}$, $y_{Tnor_min}$ for the roll eccentricity amount of the upper backup roll 4*a* based on the roll eccentricity amounts $y_{T0}, y_{T1}, \ldots y_{Tn-1}$. On the other hand, the processing in step S1402 also calculates each representative value $\Delta y_{Bnor_peak}$, $y_{Bnor_max}$, $y_{Bnor_min}$ for the roll eccentricity amount of the lower backup roll 4*b* based on the roll eccentricity amounts $y_{B0}, y_{B1}, \ldots y_{Bn-1}$.

Next, abnormality of each backup roll 4*a*, 4*b* as the monitored roll is determined based on whether or not at least one condition of the following plurality of conditions (b1) to (b3) is satisfied (step S1403), wherein the coefficient m may be set to 2 as an example:

(b1) the roll eccentricity amount peak-to-peak value $\Delta y_{peak}$ is greater than a value which is acquired by multiplying the normal roll eccentricity amount peak-to-peak value $\Delta y_{nor_peak}$ by the coefficient m;

(b2) the roll eccentricity maximum value $y_{max}$ is greater than a value which is acquired by multiplying the normal roll eccentricity maximum value $y_{nor_max}$ by the coefficient m; and (b3) the roll eccentricity minimum value $y_{min}$ is smaller than a value which is acquired by multiplying the normal roll eccentricity minimum value $y_{nor_min}$ by the coefficient m.

Incidentally, roll state determination based on the above plural conditions (b1) to (b3) may be preferably executed for each monitored roll when there are a plurality of monitored rolls. In the first embodiment, a plurality of representative values $\Delta y_{Tnor_peak}$, $y_{Tnor_max}$, $y_{Tnor_min}$ calculated in step S1402 is used to determine the roll state of the upper backup roll 4*a*. On the other hand, a plurality of representative values $\Delta y_{Bnor_peak}$, $y_{Bnor_max}$, $y_{Bnor_min}$ calculated in step S1402 is used to determine the roll state of the lower backup roll 4*b*.

As a modification, when two or more of the plural conditions (b1) to (b3) are satisfied, the monitored roll may be determined to be abnormal. As a further modification, when all of the plural conditions (b1) to (b3) are satisfied, the monitored roll may be determined to be abnormal.

Figure 7:
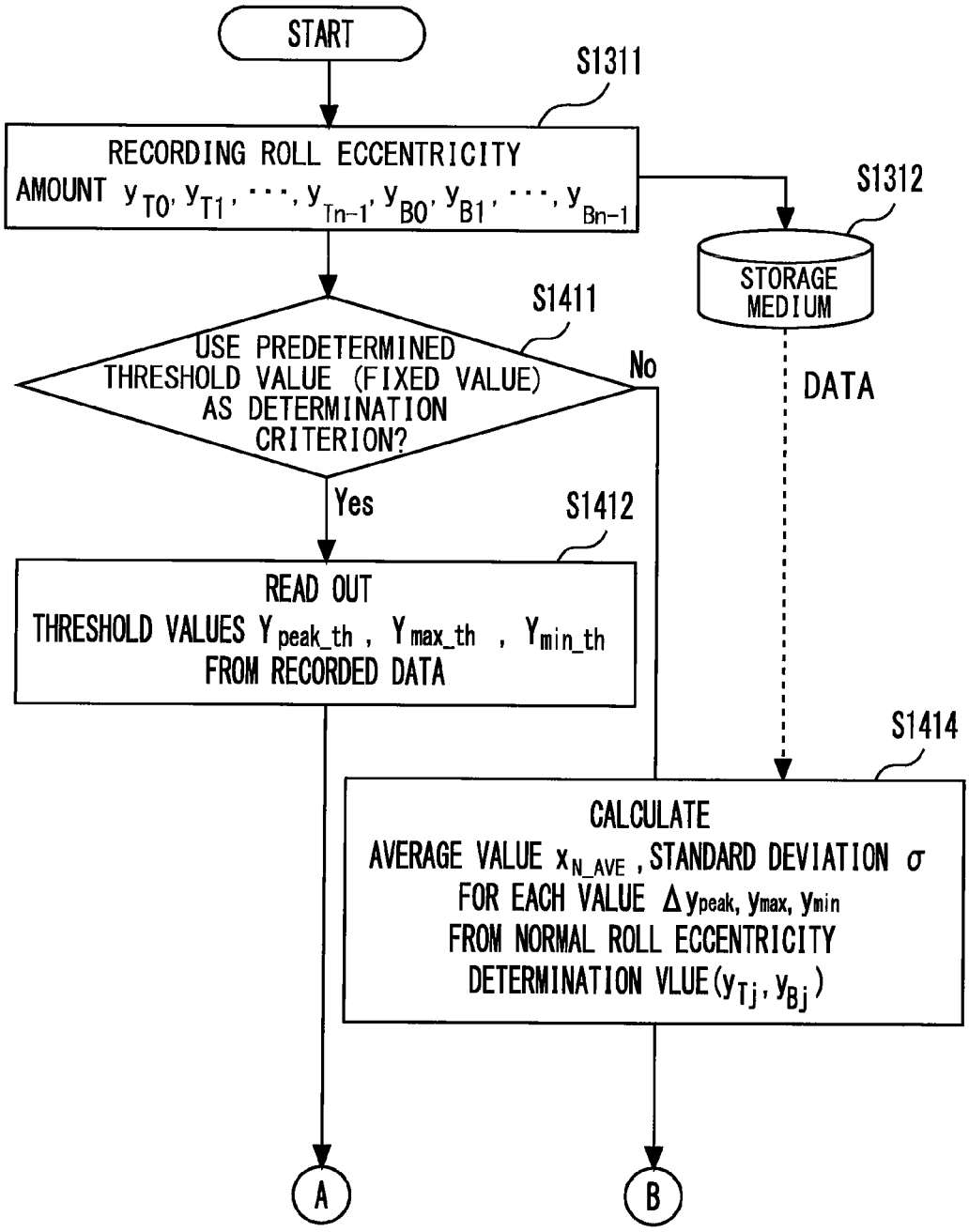
FIG. 7 is a flowchart for explaining a second roll state determination technique according to a modification of the first embodiment.
Figure 8:
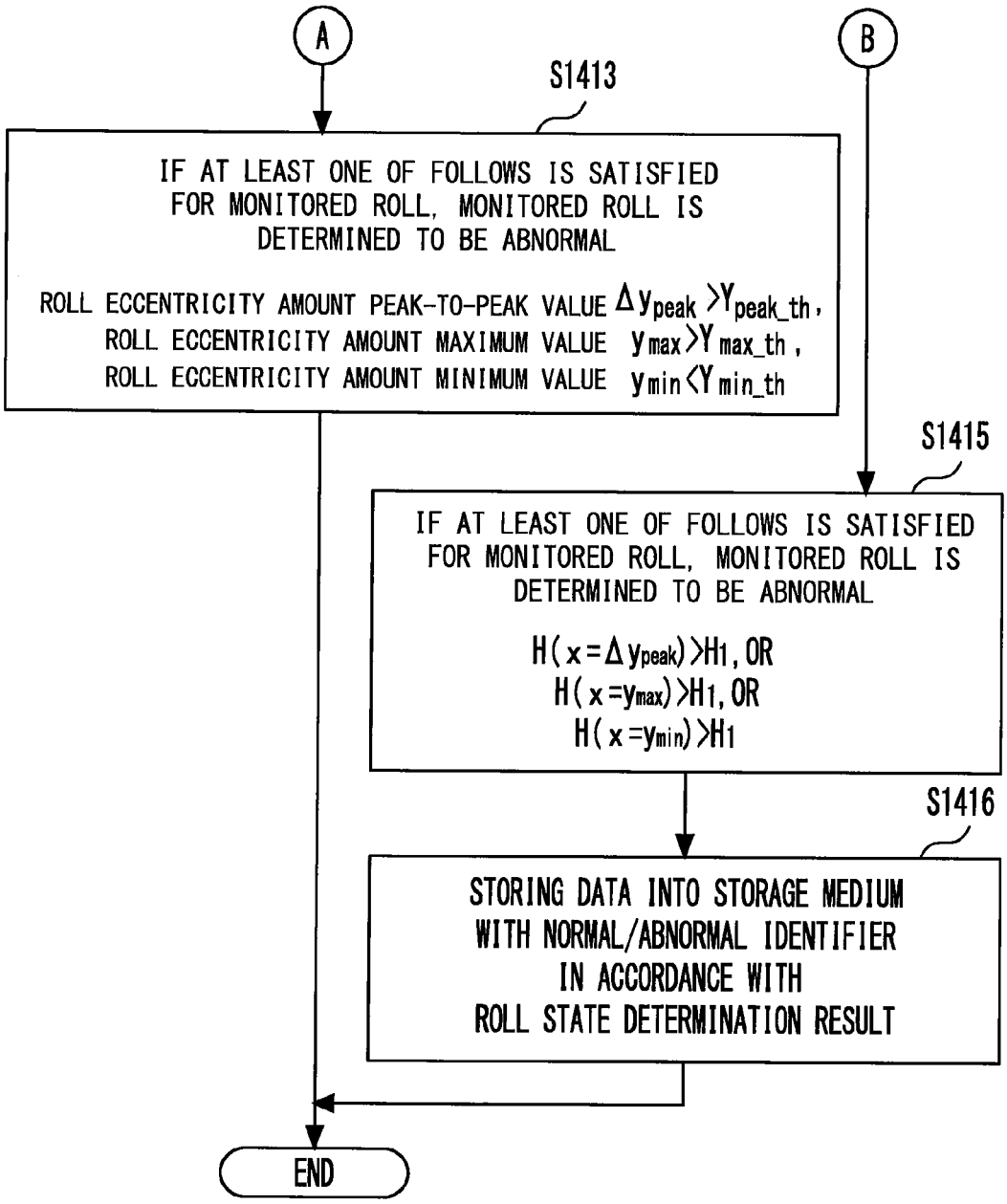
FIG. 8 is a flowchart for explaining the second roll state determination technique according to a modification of the first embodiment.

FIGS. 7 and 8 are flowcharts for explaining a second roll state determination technique according to a modification of the first embodiment. The second roll state determination technique illustrated in FIGS. 7 and 8 provides a technique in which the roll eccentricity amount recording part 13 and the roll state determination part 14 perform an abnormality determination of the roll state according to a method different from the first roll state determination technique in FIG. 6.

Roll state determination based on a "statistical test method" is the second roll state determination technique, which is a base of the routines of FIGS. 7 and 8. In the first embodiment, as an example of the second roll state determination technique, H (x) is calculated according to the following equation (1).

[Expression 2]

$$H(x) = \frac{(x - x_{N_AVE})^2}{\sigma_N^2} \tag{1}$$

Parameters included in the right side of the equation (1) will now be described. Here, as an example, the roll eccentricity peak-to-peak value $\Delta y_{peak}$ is subjected to the statistical test method. Into a parameter "x", the roll eccentricity amount peak-to-peak value $\Delta y_{peak}$ acquired in the present rolling process is substituted. An average value is acquired by averaging a plurality of the normal roll eccentricity amount peak-to-peak values $\Delta y_{nor_peak}$ acquired in the past, and the average value is substituted into a parameter $x_{N_AVE}$. Into a parameter $\sigma_N$, a standard deviation of the roll eccentricity peak-to-peak value $\Delta y_{peak}$ is substituted. These parameters $x_{N_AVE}$ and $\sigma_N$ are calculated from data acquired in rolling processes of the plurality of rolled material 1 in which the monitored roll is the same.

H(x) of equation (1) follows a chi-square distribution with a degree of freedom of 1.

This is called "Hotelling theory". That is, probability of occurrence is determined by a value acquired when H(x) is substituted into an expression of the chi-squared distribution with one degree of freedom.

The value of the chi-squared distribution is generally provided in a form of a number table and thus the value may be taken from the number table, or the value may be calculated by the following equation (2).

[Expression 3]

$$f(y;k) = \frac{1}{2^{\frac{k}{2}} G\left(\frac{k}{2}\right)} y^{\frac{k}{2}-1} \exp\left(-\frac{y}{2}\right) \tag{2}$$

Here, k=1, y=H(x). A gamma function G is G(½)=√π.

When a data set X={x1, x2 . . . xn} is given, a standard deviation σ of the data set X can be calculated as follows. Where $XA_vE$ is an average value of the data set X.

[Expression 4]

$$\sigma = \sqrt{\frac{1}{n-1} \sum_{i=1}^{n} (x_i - X_{AVE})^2} \tag{2a}$$

In the above, for example, when H(x)=5.7 is acquired, a value of the chi-squared distribution with degree of freedom 1 is 0.0097. When H(x)=5.7, probability of acquiring x thereof is 0.97%, that is less than 1%. If H(x) becomes large, this is caused by a large difference in x as compared with its average value in the past. In such a case, since there has occurred an abnormal state in which occurrence probability is very low, the roll state can be regarded as abnormal.

In general, a 5% significance level or a 1% significance level is used. Thus, it is determined to be abnormal at the 5% significance level, or it is determined to be abnormal at the 1% significance level.

Next, contents of specific control in FIGS. 7 and 8 will now be described. The routine of FIGS. 7 and 8 is executed by the roll eccentricity amount recording part 13 and the roll state determination part 14.

Incidentally, step S1414 of FIG. 7 and steps S1415, S1416 of FIG. 8 are intended to achieve the second roll state determination technique based on the above equation (1) and the like. However, on the other hand, a third roll state determination technique (step S1412, S1413) is also included in FIGS. 7 and 8. The third roll state determination technique determines whether or not the roll state is normal based on a comparison determination using a fixed value determined from data acquired in the past.

In the routine of FIG. 7, first, the roll eccentricity amount identified by the roll eccentricity amount identification part 12 is recorded by the roll eccentricity amount recording part 13 (step S1311). In this step, the roll eccentricity amount recording part 13 records each of the roll eccentricity amounts $y_{T0}$, $y_{T1}$ . . . $y_{Tn-1}$ and the roll eccentricity amounts $y_{B0}$, $y_{B1}$ . . . $y_{Bn-1}$ each time rolling process of the rolled materials 1 is completed. The recorded data is stored in the recording medium in the roll eccentricity amount recording part 13 (step S1312).

Next, it is determined whether a predetermined fixed threshold value is used as a determination criterion (step S1411). Whether to use or not the fixed threshold value in step S1411 is determined based on a state of a determination method flag which is prepared in advance. If the determination method flag is 1, determination result in step S1411 is affirmative (YES). If the determination method flag is 0, determination result in step S1411 is negative (NO). The determination method flag is assumed to be preset and to be capable of being changed afterward.

If the determination result in the step S1411 is affirmative (YES), processing proceeds to step S1412 and step S1413 in FIG. 8, and the third roll state determination technique described above is performed.

First, in step S1412, three types of threshold values in the following (c1) to (c3) are read from the recording data in the roll eccentricity amount recording part 13. These threshold values are fixed values which are set in advance by using data acquired in the past rolling process or by using simulation data. These three types of threshold values may be set independently for each of the upper monitored roll and the lower monitored roll, or may be set to common values for both the upper and lower monitored rolls.

(c1) A first threshold value $Y_{peak_th}$ is defined for determining the roll eccentricity peak-to-peak value $\Delta y_{peak}$.

(c2) A second threshold value $Y_{max_th}$ is defined for determining the roll eccentricity maximum value $y_{max}$.

(c3) A third threshold value $Y_{min_th}$ is defined for determining the roll eccentricity minimum value $y_{min}$.

Next, in step S1413 of FIG. 8, it is determined whether or not each of the backup rolls 4*a*, 4*b* of the monitored roll is abnormal based on whether or not at least one of the following plural conditions (d1) to (d3) is satisfied:

(d1) the roll eccentricity peak-to-peak value $\Delta y_{peak}$ is larger than the first threshold value $Y_{peak_th}$;

(d2) the roll eccentricity maximum value $y_{max}$ is larger than the second threshold value $V_{max_th}$; and (d3) the roll eccentricity minimum value $y_{min}$ is smaller than the third threshold value $Y_{min_th}$.

Incidentally, roll state determination based on the above plural conditions (d1) to (d3) may be preferably executed for each monitored roll when there are a plurality of monitored rolls.

As a modification, the monitored roll may be determined to be abnormal when two of the above plural conditions (d1) to (d3) are satisfied. Further, the monitored roll may be determined to be abnormal when all of the plural conditions (d1) to (d3) are satisfied.

If determination result in the step S1411 is negative (NO), processing proceeds to step S1414 and steps S1415, S1416 in FIG. 8. Thereby, the second roll state determination technique described above is performed.

First, in step S1414, calculation of each various parameter described in the following (e1) to (e3) is performed:

(e1) the average value $x_{N_AVE}$ and the standard deviation $\sigma_N$ for the roll eccentricity peak-to-peak values $\Delta y_{peak}$;

(e2) the average value $x_{N_AVE}$ and the standard deviation $\sigma_N$ for the roll eccentricity maximum values $y_{max}$; and (e3) the average value $x_{N_AVE}$ and the standard deviation $\sigma_N$ for the roll eccentricity minimum values $y_{min}$.

Next, in step S1415 of FIG. 8, it is determined whether or not each of the backup rolls 4*a*, 4*b* of the monitored roll is abnormal based on whether or not at least one of the following plural conditions (f1) to (f3) is satisfied. It should be noted that a threshold value $H_1$ is predetermined. For example, H1=5.7 may be set to test at the 1% significance level.

(f1) $H(x=\Delta y_{peak})$ is larger than the threshold value $H_1$.

(f2) $H(x=y_{max})$ is larger than the threshold value $H_1$.

(f3) $H(x=y_{min})$ is larger than the threshold value $H_1$.

However, in the above conditions (f1) to (f3), $H(x=\Delta y_{peak})$ is acquired by substituting into the equation (1) the average value $x_{N_AVE}$ and the standard deviation $\sigma_N$ for the roll eccentricity peak-to-peak values $\Delta y_{peak}$. $H(x=y_{max})$ is acquired by substituting into the equation (1) the average value $x_{N_AVE}$ and the standard deviation $\sigma_N$ for the roll eccentricity maximum values $y_{max}$. $H(x=y_{min})$ is acquired by substituting into the equation (1) the mean value $x_{N_AvE}$ and the standard deviation $\sigma_N$ for the roll eccentricity minimum values $y_{min}$.

Incidentally, it is preferable that each monitored roll is subjected to calculation processing of the above parameters (e1) to (e3) and roll state determination processing based on the plural conditions (f1) to (f3), when there are a plurality of monitored rolls. In the first embodiment, these processings are performed independently about each of the upper backup roll 4*a* and the lower backup roll 4*b*.

That is, in the first embodiment, the roll state of the upper backup roll 4*a* is determined in step S1415 by using the plurality of parameters calculated in step S1414 based on the roll eccentricity amounts $y_{T0}$, $y_{T1}$, . . . $y_{Tn-1}$. On the other hand, the roll state of the lower backup roll 4*b* is determined in step S1415 by using the plurality of parameters calculated in step S1414 based on the roll eccentricity amounts $y_{B0}$, $y_{B1}$, . . . $y_{Bn-1}$.

As a modification, the monitored roll may be determined to be abnormal when two or more of the plural conditions (f1) to (f3) are satisfied. Further, the monitored roll may be determined to be abnormal when all of the plural conditions (f1) to (f3) are satisfied.

In step S1416, the roll eccentricity amount recording part 13 stores calculation data in step S1414 with a normal or abnormal identifier in the recording medium thereof in accordance with the roll state determination result of normal or abnormal. Data storing processing with the identifier in step S1416 may be preferably executed for each monitored roll independently, when there are a plurality of monitored rolls. In the first embodiment, the plural parameters (e1) to (e3) are calculated in step S1414 for each of the upper backup roll 4*a* and the lower backup roll 4*b* independently, and the parameters (e1) to (e3) are stored with the identifier indicating one of normal and abnormal.

Incidentally, when the Hotelling theory is carried out in the above routine of FIG. 6, determination is executed based on a little number of data because the number of data in the normal state is about 5 to 10. On the other hand, in the case of the routines in FIGS. 7 and 8, a large number of past data are accumulated by the roll eccentricity amount recording part 13, and this makes it possible to sufficiently acquire a large amount of data to be compared. Hence, there are advantages that the Hotelling theory can be easily applied to the abnormality determination of the routines in FIGS. 7 and 8.

Figure 9:
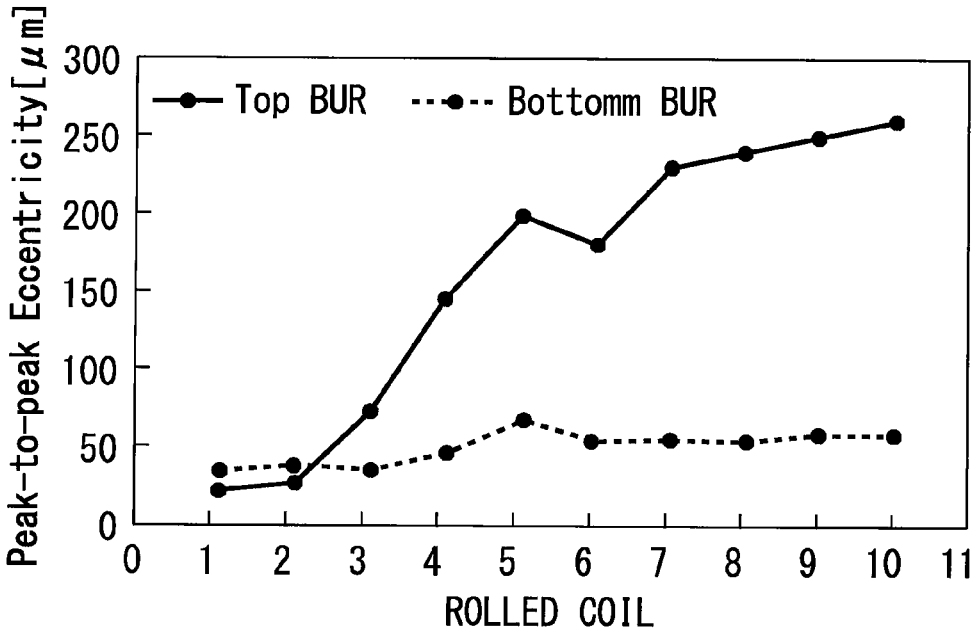
FIG. 9 is a diagram illustrating transition of an actual roll eccentricity amount according to the first embodiment.

FIG. 9 is a diagram for explaining transition of an actual roll eccentricity amount according to the first embodiment. In the first embodiment, as an example, the roll state determination part 14 is provided with displaying function to display the roll eccentricity amount peak-to-peak value $\Delta y_{peak}$. As an example, the roll eccentricity amount peak-to-peak values $\Delta y_{peak}$ for a plurality of the rolled materials 1 are acquired by going back in the past from the rolled material 1 that has been most recently rolled, and these acquired values are being displayed in FIG. 9. The roll eccentricity amount peak-to-peak value $\Delta y_{peak}$ is the difference between the maximum value and the minimum value of the roll eccentricity amounts outputted from the roll eccentricity amount identify part 12.

A horizontal axis of FIG. 9 represents the number of the rolled material. The roll state is normal in the first coil and the second coil in FIG. 9. In FIG. 9, it is presumed that roll breakage may start around the third or fourth coils. In the example of FIG. 9, an operator finds an abnormality at the tenth coil, and then stops the rolling mill 50. When the roll has been extracted and checked, a damaged part of the upper backup roll has been found at the drive side (DS). Occurrence of this damaged part in the roll is consistent with increased eccentricity in the upper backup roll 4*a* in FIG. 9.

First Modification of the First Embodiment

A first modification of the embodiment will now be described. Although the backup rolls 4*a*, 4*b* are monitored rolls in FIGS. 3, 4 and 5, the roll state monitor device 20 according to the first embodiment is not limited thereto. Each of the work rolls 3*a*, 3*b* may be a monitored roll. The monitored roll can be arbitrarily selected from among a plurality of rolls included in the upper roll set and the lower roll set.

Incidentally, both the backup rolls 4*a*, 4*b* and the work rolls 3*a*, 3*b* may be independently monitored. In this case, two roll state monitor devices 20 in FIG. 5 are provided. This is because independent roll state determination by each roll state monitor device 20 are preferably performed since rotation speed of the backup rolls 4*a*, 4*b* is different from that of the work rolls 3*a*, 3*b*.

Second Modification of the First Embodiment

Figure 10:
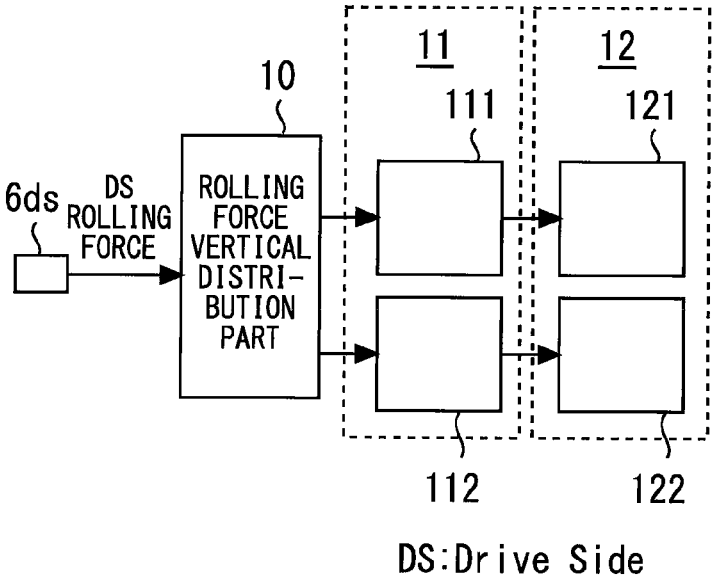
FIG. 10 is a diagram illustrating a configuration of a roll state monitor device according to a second modification of the first embodiment.
Figure 10:
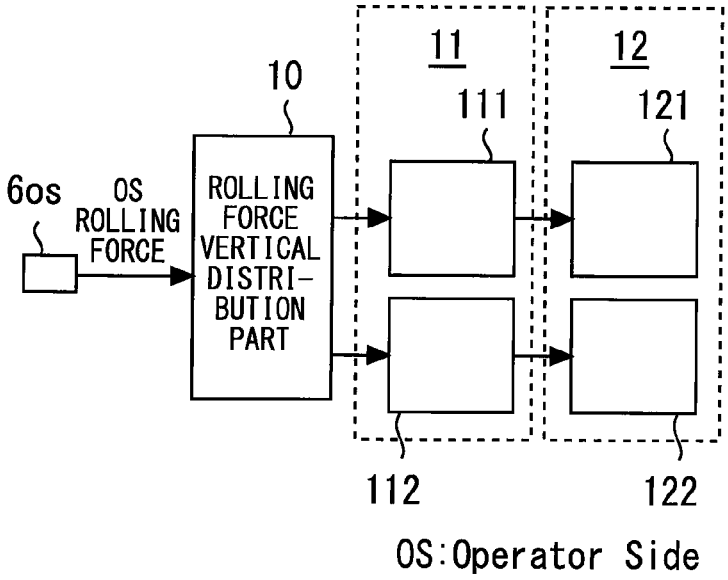

FIG. 10 is a diagram illustrating a configuration of a roll state monitor device 20 according to a modification of the first embodiment. In FIG. 10, for convenience, a block 10, a block 11, a block 12, a block 111, a block 112, a block 121, and a block 122 in FIG. 5 are simplified.

The roll state monitor device 20 according to the first embodiment uses one rolling force value per one rolling stand when monitoring the backup rolls 4*a*, 4*b*, as in FIGS. 3, 4 and 5. However, in the rolling mill 50, each rolling force at two end positions in the roll width direction may be measured individually for each rolling stand #1 to #7.

The two ends in the roll width direction are a drive side (DS: Drive Side) and an operator side (OS: Operator Side). This is also illustrated in FIG. 1. In the second modification, as shown in FIG. 10, drive-side rolling force detecting means 6*ds* and operator-side rolling force detecting means 6*os* are respectively provided at two end portions of the roll width direction.

In the second modification, two roll state monitor devices 20 are assigned for DS rolling force detection and OS rolling force detection, respectively. The roll state monitor device 20 for DS rolling force mainly monitors a roll state of the drive side based on output signals from the drive-side rolling force detecting means 6*ds*. The roll state monitor device 20 for OS rolling force mainly monitors a roll state of the operator side based on output signals from the operator side rolling force detecting means 6*os*.

Incidentally, abnormality occurring in a central portion in the roll width direction is detected in both the drive side and the operator side in common. Therefore, there may occur each of a first case in which an abnormality is detected only on the drive side, a second case in which an abnormality is detected only on the operator side, and a third case in which an abnormality is detected on both of the drive side and the operator side. The second modification may roughly determine a position at which abnormality has occurred in the roll width direction among the drive side, the operator side, and the central portion by distinguishing the first case, the second case, and the third case. Calculation capability will be preferably recognized since processing amount in FIG. 10 is about twice larger than that in FIG. 5.

Third Modification of the First Embodiment

Although the roll state monitor device 20 according to the second modification monitors the backup rolls 4*a*, 4*b*, a third modification thereof monitors the work rolls 3*a*, 3*b*. Incidentally, when each backup roll 4*a*, 4*b* and each work roll 3*a*, 3*b* are independently monitored, there may be provided four of the roll state monitor devices 20 in FIG. 10 in total.

Fourth Modification of the First Embodiment

A fourth modification is a modification including the second modification and the third modification of the roll state monitor device 2. In other words, each of the backup rolls 4*a*, 4*b* and the work rolls 3*a*, 3*b* is set as the monitored roll, and each roll state monitor function for the DS and the OS is independently provided. It is sufficient to provide a total of four roll state monitor devices 20, since a pair of the two devices in the upper side and lower side in FIG. 10 is further required for the work roll. This results in that processing amount in the computer is about four times larger than that in the configuration of the first embodiment. As described above, it may be sufficient to increase the number of roll state monitor device 20 in accordance with increasing the number of monitored rolls.

Fifth Modification of the First Embodiment

Figure 11:
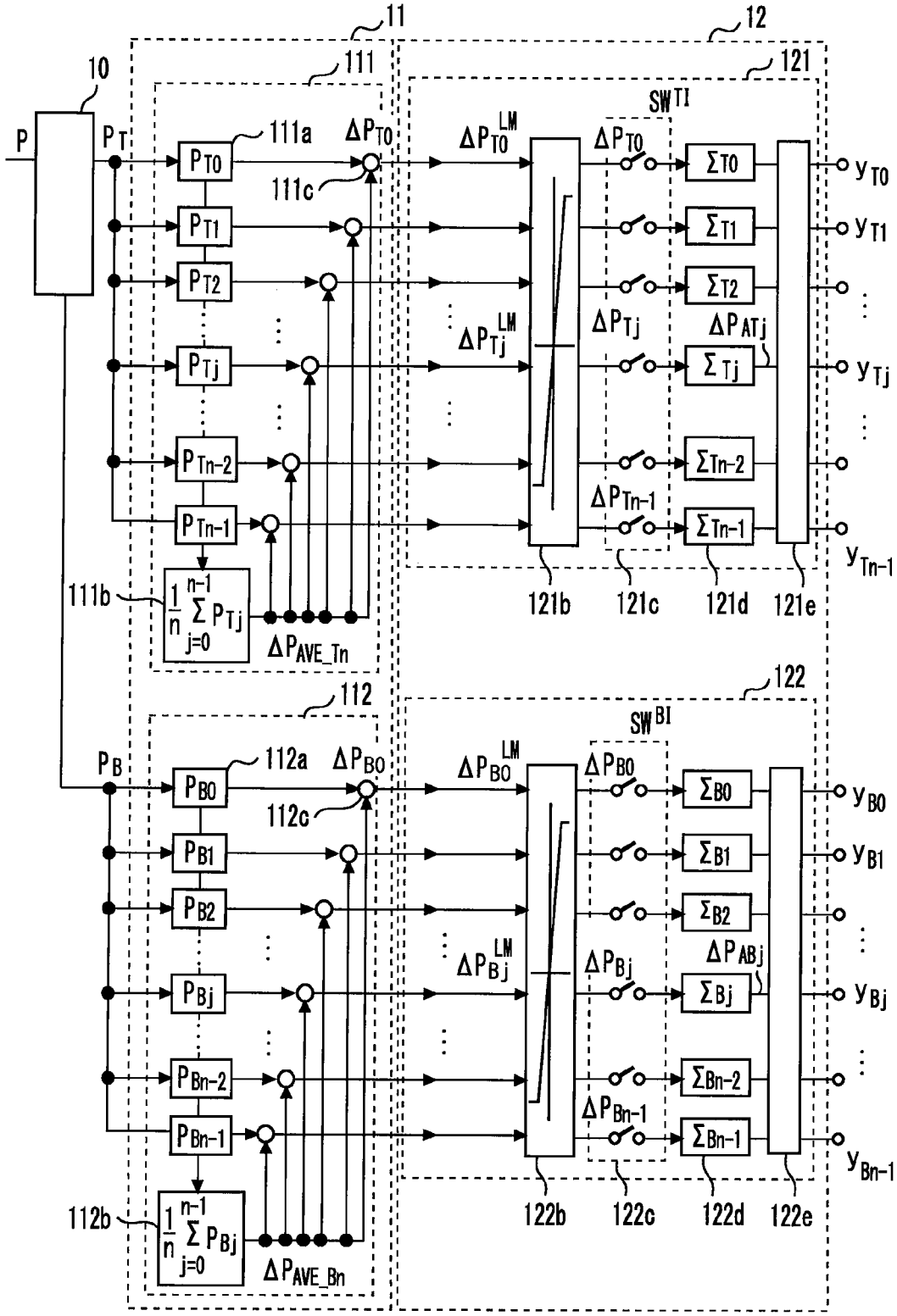
FIG. 11 is a diagram for specifically explaining a method of extracting rolling force variation and of identifying a roll eccentricity amount according to a fifth modification of the first embodiment, and a device configuration thereof.

FIG. 11 is a diagram for specifically explaining a method of extracting rolling force variation and of identifying a roll eccentricity amount according to a fifth modification of the first embodiment, and a device configuration thereof. In the modification of FIG. 11, the conversion blocks 121*a*, 122*a* are omitted from the configuration in FIG. 5. In this case, conversion into the roll gap equivalent values $\Delta S_{Tj}$, $\Delta S_{Bj}$ is not performed, and the rolling force variation values $\Delta P_{Tj}$, $\Delta P_{Bj}$ are transmitted to the limiters 121*b*, 122*b*. Each adder 121*d*, 122*d* also accumulates each rolling force variation value $\Delta P$ corresponding to the plurality of roll rotation position.

As described above, each conversion block 121*a*, 122*b* executes conversion into each roll gap equivalent value $\Delta S_{Tj}$, $\Delta S_{Bj}$, and this makes it possible to suppress variation in calculation results caused by the difference in characteristics (e.g. hardness of rolled material) of the rolled material 1 rolled by the rolling mill 50. However, such preferred features are not forced to be implemented, and therefore the conversion blocks 121*a*, 122*b* may be omitted. This makes it possible to reduce a calculation load in the roll eccentricity amount identify part 12.

Second Embodiment

Figure 12:
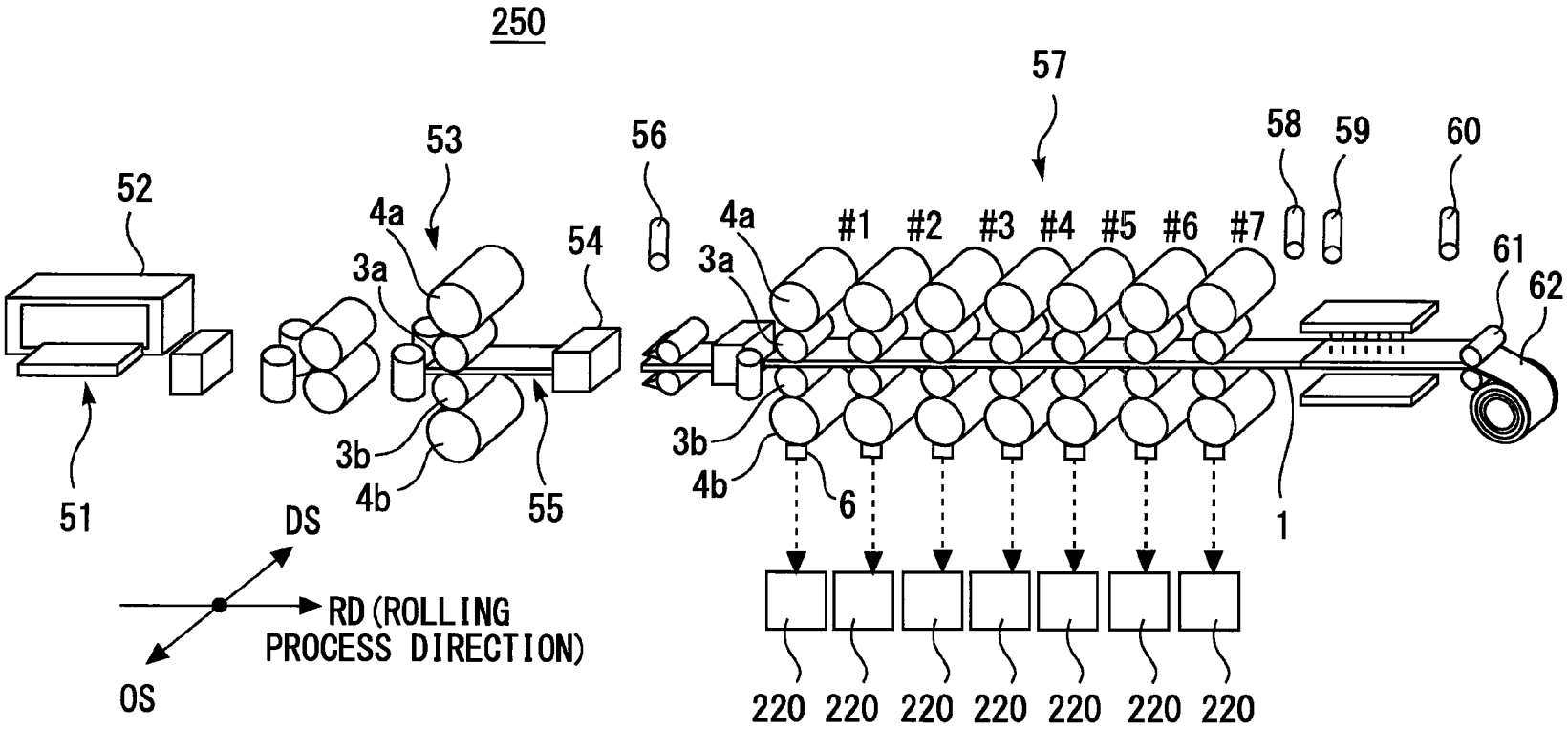
FIG. 12 is a diagram illustrating an example of a rolling mill to which a roll state monitor device according to the second embodiment is applied.
Figure 13:
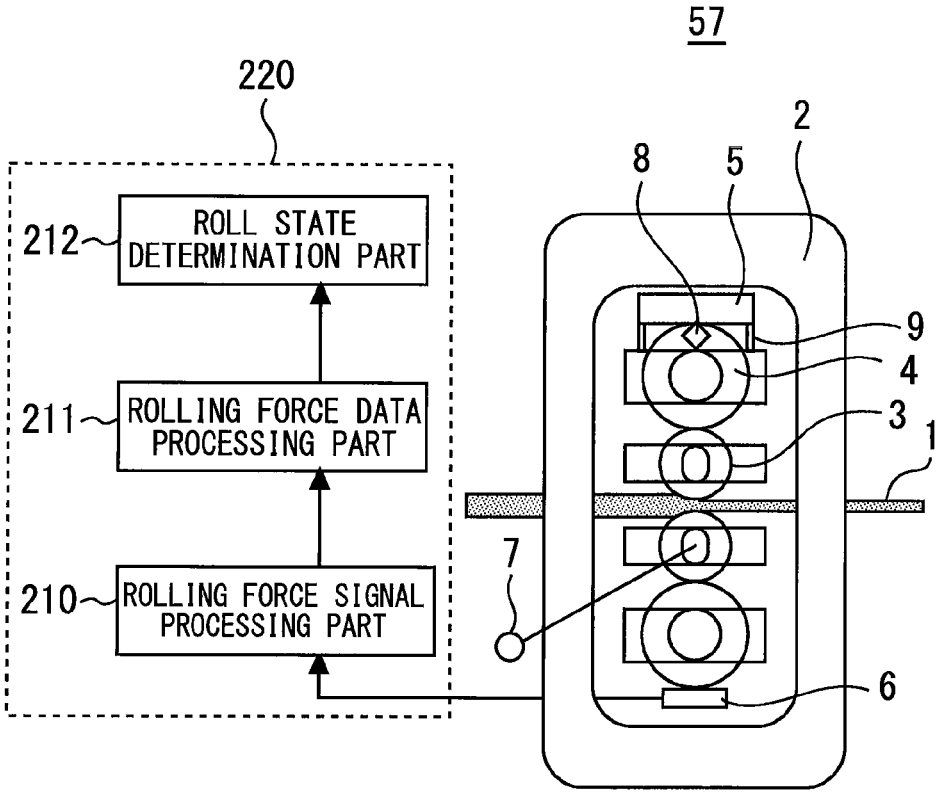
FIG. 13 is a diagram for explaining the roll state monitor device according to the second embodiment and configuration of an upper roll set and a lower roll set.

FIG. 12 is a diagram illustrating an example of a rolling mill 250 to which a roll state monitor device 220 according to the second embodiment is applied. FIG. 13 is a diagram for explaining the roll state monitor device 220 according to the second embodiment and configuration of the upper roll set and the lower roll set The second embodiment and the first embodiment are different with each other in that the roll state monitor device 20 is replaced with the roll state monitor device 220. As shown in FIG. 13, the roll state monitor device 220 includes a rolling force signal processing part 210, a rolling force data processing part 211 and a roll state determination part 212. Hereinafter, the same components as those in the first embodiment are denoted by the same reference numerals, description thereof will be omitted, the following description will be given with focus on the differences between the first embodiment and the second embodiment.

Figure 14:
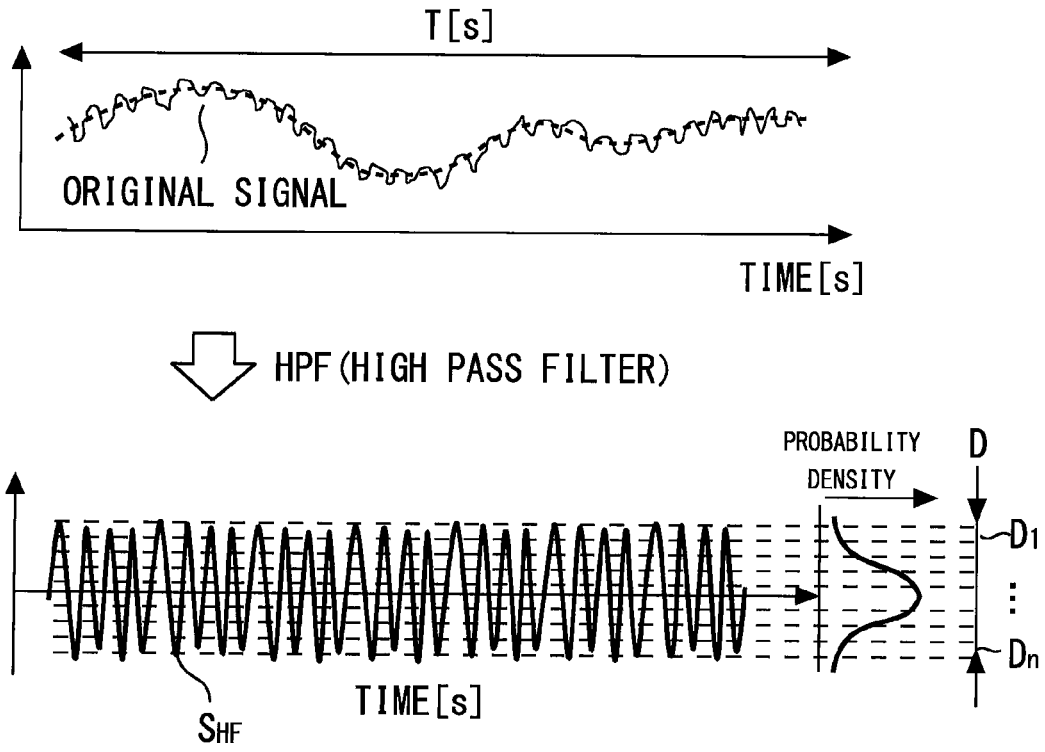
FIG. 14 is a diagram for explaining a roll state determination technique according to the second embodiment.

FIG. 14 is a diagram for explaining a roll state determination technique according to the second embodiment. In the second embodiment, the rolling force detecting means 6 detects the rolling force which the rolling mill 250 receives from the rolled material 1, similarly to the first embodiment. A load detection signal detected by the rolling force detecting means 6 is also referred to as an "original signal".

In the second embodiment, signal processing and determination processing in the following FIGS. 14 to 20 are performed based on the load detection signal detected by the rolling force detecting means 6. The monitored roll in the second embodiment is a roll subjected to rolling force corresponding to the load detection signal to which these signal processing and determination processing are applied.

The monitored roll in the second embodiment can be arbitrarily selected in the same manner as in the first embodiment. Although the rolling force vertical distribution part 10 of the first embodiment is omitted in FIG. 13, when a value of the rolling force is distributed by the rolling force vertical distribution part 10 to the upper and lower rolls, at least one of the upper and lower rolls may be selected as the monitored roll. The rolling force detecting means 6 may be configured to detect the rolling force in DS and OS separately as in the fourth modification of the first embodiment described above.

In an upper part of FIG. 14, a low-frequency component and a high-frequency component contained in the original signal are schematically illustrated. Here, the original signal is assumed to be a signal representing an absolute value of rolling force. The detected original signal generally includes the low frequency component (i.e. dashed line in the upper part of FIG. 14) exhibiting slow vibration and the high frequency component (i.e. thin solid line in the upper part of FIG. 14) such as a noise.

The rolling force signal processing part 210 applies HPF (high-pass filter) to the original signal. This extracts the high-frequency component by removing the low-frequency component in the rolling force signal by a high-pass filter or the like, and the high-frequency component in the rolling force can be set as a rolling force high-frequency signal $S_{HF}$. A lower part of FIG. 14 schematically illustrates an example of the rolling force high-frequency signal $S_{HF}$ extracted by HPF. The diagram in the lower part of FIG. 14 is merely a schematic diagram, and an actual waveform of the rolling force high-frequency signal $S_{HF}$ may be different therefrom.

The rolling force data processing part 211 calculates a standard deviation σ of the rolling force high-frequency signaling $S_{HF}$. The rolling force data processing part 211 calculates the difference "d" between a probability density distribution of ±kσ and a normal distribution. A value of k is 2 to 5, for example.

The rolling force data processing part 211 is provided with a vertical axis range D which is sufficiently larger than amplitude of the rolling force high-frequency signal $S_{HF}$. As shown in FIG. 14, the vertical axis range D is divided into n sections $D_n$ which is set in advance. The rolling force data processing part 211 regards the rolling force high-frequency signal $S_{HF}$ as a set of data, and thereby counts the number of data contained in each section $D_n$ of the vertical axis range D.

The rolling force data processing part 211 divides the number of the data belonging to each section by the total number of the data, and calculates probability in each section. Such calculation is applied to all of the plurality of sections $D_1$, $D_2$, $D_3$ . . . Dn, and this makes it possible to acquire a probability density distribution in a lower right part of FIG. 14.

The longitudinal axis range D may be set to be about 4σ which is four times the standard deviation σ in order to have sufficiently larger range than the amplitude of the rolling force high-frequency signal $S_{HF}$. Thus, the almost every datum can be included in the vertical axis range. Data ranges covered by the vertical axis range D according to σ are specifically defined such that 2σ=95.4%, 3σ=99.7%, and 4σ=99.994%, etc.

Figure 15:
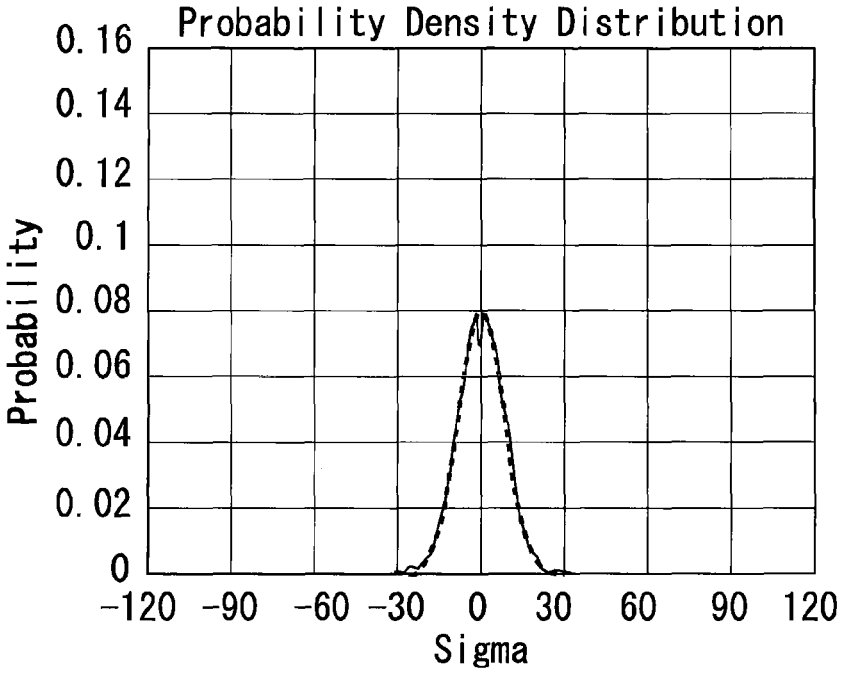
FIG. 15 is a graph for explaining a probability density distribution according to the second embodiment.

FIG. 15 is a graph for explaining a probability density distribution according to the second embodiment. FIG. 15 is an example of an actual probability density distribution. FIG. 15 illustrates the probability density distribution of the actual data with a solid line, and the actual data is the same data as the data used in the graph of FIG. 9. The solid line data in FIG. 15 is data based on the rolling force detected on the drive side of a damaged rolling stand. The solid line data in FIG. 15 is drawn to show a probability density distribution acquired by the following manner: data is detected in a first rolling process in FIG. 9; the detected data is subjected to a high-pass filter to acquire the rolling force high-frequency signal $S_{HF}$; and the probability density distribution is acquired from the rolling force high-frequency signal $S_{HF}$.

Figure 16:
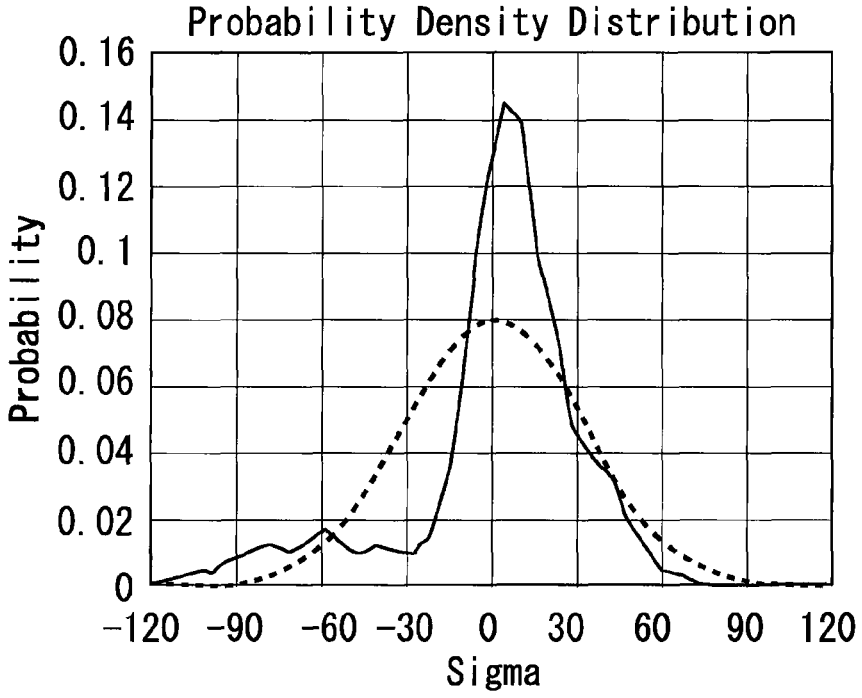
FIG. 16 is a graph illustrating a probability density distribution according to the second embodiment.

FIG. 16 is a graph illustrating a probability density distribution according to the second embodiment. Unlike FIG. 15, the solid line data in FIG. 16 illustrates a probability density distribution of the rolling force high-frequency signal $S_{HF}$ extracted from the rolling force signal in the tenth rolling process in FIG. 9. Each horizontal axis in FIGS. 15 and 16 is defined so as to have ±4σ of the tenth signal in FIG. 5 and to have a common scale.

In FIGS. 15 and 16, a normal distribution for comparison is illustrated with broken-line data. In FIG. 15, a dashed line graph showing a normal distribution overlaps with a solid line graph showing actual data. When the monitored roll is in a normal state, the probability density distribution acquired from the rolling force high-frequency signaling $S_{HF}$ is consistent with the normal distribution as shown in FIG. 15. In contrast, when the monitored roll becomes an abnormal state, the probability density distribution is clearly different from the normal distribution as shown in FIG. 16. Distinguishing the above difference makes it possible to determine whether or not the monitored roll is in an abnormal state.

The roll state determination part 212 may output the graph in FIG. 16 through a device such as a display or the like so that an operator can directly see the graph. This may cause a person to visually and clearly recognize abnormality. However, difference between distribution shapes may be represented by a numerical value, and the roll state determination part 212 may automatically output an abnormality determination signal based on the numerical value. This may provide an objective and automatic notification of occurrence of abnormality.

Each numerical index in the following equations (4) to (6) may be used, as an example, in order to calculate the value "d" representing difference between the probability density distribution and the normal distribution. The equation (4) is an equation for determining a value $D_{KL}$ of "Kullback-Leibler Divergence." The equation (5) is an equation for acquiring a value $D_{SQ}$ based on the error sum of squares. The equation 6 is an equation for acquiring a value $D_{ABS}$ based on the error absolute value sum.

The roll state determination part 212 may calculate the difference d between the probability density distribution and the normal distribution based on at least one equation in the three example equations (4) to (6). In other words, the difference d may be any one of the values $D_{KL}$, $D_{SQ}$, $D_{ABS}$. If the difference d is equal to or larger than a predetermined determination value which is set in advance, the roll state may be determined to be abnormal.

[Expression 5]

$$D_{KL}(P_N \parallel P_A) = \sum_x P_N(x)\log\frac{P_N(x)}{P_A(x)} \tag{4}$$

[Expression 6]

$$D_{SQ} = \sum_x (P_N(x) - P_A(x))^2 \tag{5}$$

[Expression 7]

$$D_{ABS} = \sum_x |P_N(x) - P_A(x)| \tag{6}$$

In the above equations, $P_A(x)$ is an actual probability density taken by a datum x. In the second embodiment, the datum x is a value of the rolling force high-frequency signal $S_{HF}$. $P_N(x)$ is a normal distribution. In general, a high frequency signal can be nearly considered as noise. The noise is white noise and can be regarded to be normally distributed. However, when the rolling force signal contains some noise signal caused by abnormality, a probability density distribution of the rolling force high frequency signal $S_{HF}$ becomes clearly different from the normal distribution. Therefore, it is possible to determine the abnormality in the roll state based on comparison between the probability density distribution and the normal distribution.

Figure 19:
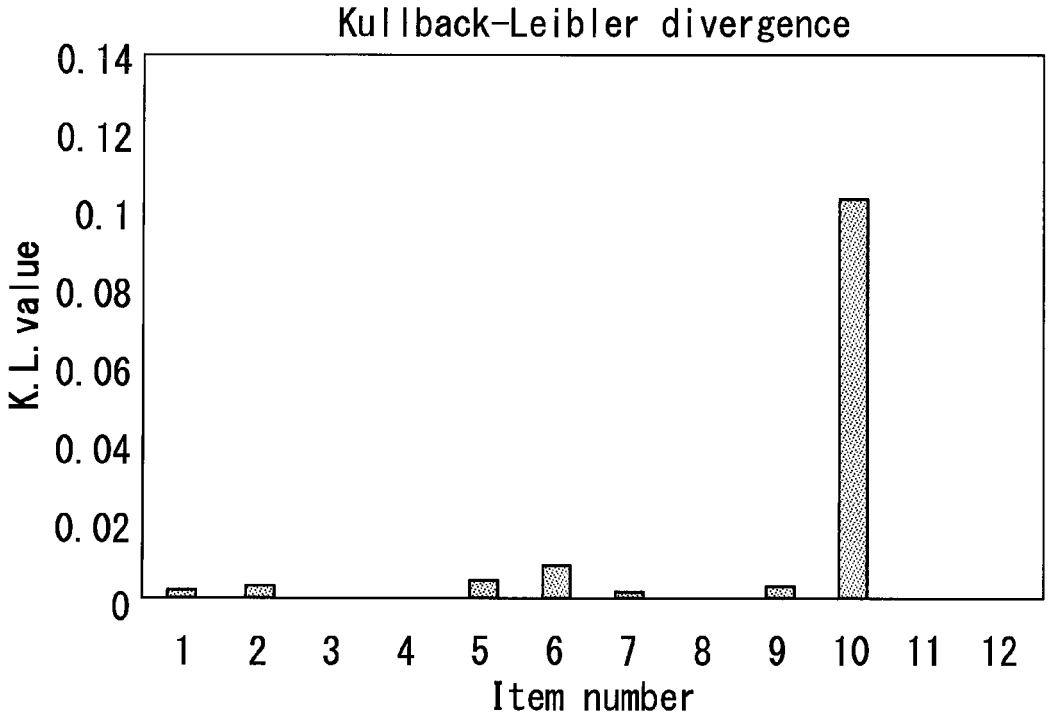
FIG. 19 is a diagram for explaining Kullback-Leibler Divergence according to the second embodiment.

FIG. 19 is a diagram for explaining Kullback-Leibler Divergence in the second embodiment. FIG. 19 represents results acquired from the data acquired in the tenth rolling process in FIG. 9. The probability density distribution is acquired for each rolling force high-frequency signaling $S_{HF}$ on each side of the drive side and the operator side in the plurality of rolling stands, and then the Kullback-Leibler Divergence $D_{KL}$ is plotted, which is an example of the difference d between the probability density distribution and the normal distribution.

The greater the value $D_{KL}$ of the Kullback-Leibler divergence is, the greater the difference between two compared distributions is. Therefore, for example, the roll state may be determined to be abnormal if the value $D_{KL}$ is equal to or greater than a predetermined determination value $D_{KL_th}$ which is set in advance. Similarly, the roll state may be determined to be abnormal if the value $D_{SQ}$ or $D_{ABS}$ is equal to or greater than a predetermined determination value $D_{SQ_th}$ or $D_{ABS_th}$ which is set in advance.

The above values $D_{KL_th}$, $D_{SQ_th}$, $D_{ABS_th}$ are also referred to as predetermined determination values $d_{th}$. The predetermined determination value $d_{th}$ is a comparison determination value for evaluating the difference d. The predetermined determination value $d_{th}$ may be a fixed value determined in advance, or may be a variable value to be sequentially updated. For example, the predetermined determination value $d_{th}$ may be set to a fixed value, or may be sequentially updated set, based on the value of the difference d calculated in at least one of previous rolling processes in which the roll state has been normal. For example, it is assumed that the n-number of differences $d_{p1}$, $d_{p2}$, $d_{p3}$ . . . $d_{pn}$ are calculated from the previous n rolling processes (p1, p2, p3 . . . pn) in which the roll state has been normal. For example, the predetermined determination value $d_{th}$ may be set based on an average value $d_{p_ave}$ of the values $d_{p1}$ to $d_{pn}$. For example, the predetermined determination value $d_{th}$ may be a value ($k_d \times d_{p_ave}$) calculated by multiplying the average value $d_{p_ave}$ by a predetermined coefficient $k_d$ which is set in advance.

In FIG. 19, a result in the item number 1st is based on the rolling force high frequency signal $S_{HF}$ on the drive-side of the first stand #1. A result in the item number 2nd is based on the rolling force high frequency signal $S_{HF}$ on the operator side of the first stand #1. A result in the item number 3rd is based on the rolling force high frequency signal $S_{HF}$ on the drive-side of the second stand #2. Item numbers are assigned up to tenth in this manner.

A result in item number tenth is based on the rolling force high-frequency signal $S_{HF}$ on the drive-side of the upper backup roll 4*a* in which crushing has been found. The tenth result corresponds to the graph in FIG. 16 which has abnormality. The tenth result indicates that the probability density distribution thereof is far from the normal distribution because the value $D_{KL}$ of the Kullback-Leibler Divergence is significantly larger than that of other item numbers.

First Modification of the Second Embodiment

Figure 17:
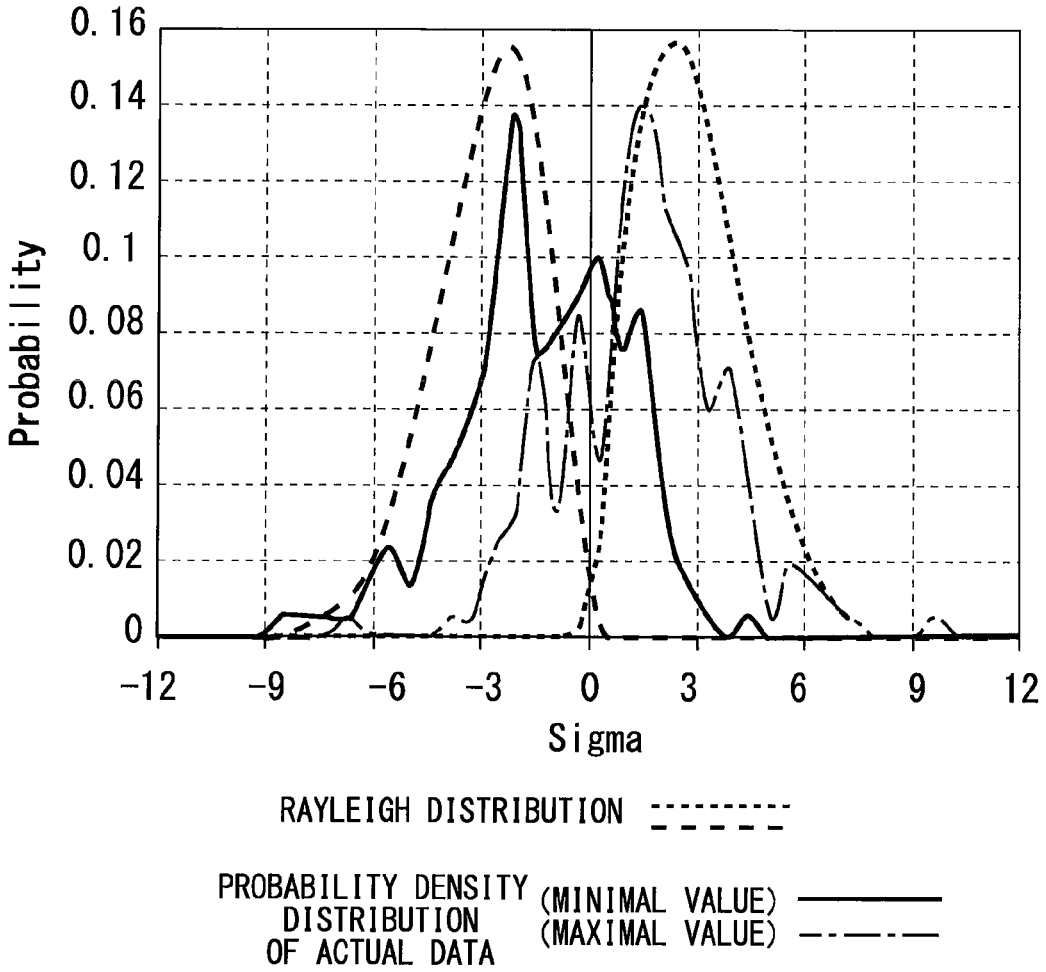
FIG. 17 is a graph illustrating a probability density distribution according to a first modification of the second embodiment.

FIG. 17 is a graph illustrating a probability density distribution according to a first modification of the second embodiment. FIG. 17 illustrates an example in which maximal values and minimal values in the rolling force high-frequency signal $S_{HF}$ in the second embodiment are plotted graphically into two probability density distributions separately.

FIG. 17 illustrates a probability density distribution of the maximal values, a probability density distribution of the minimal values, and a Rayleigh distribution. When each of the probability density distribution of the maximal values and the probability density distribution of the minimal values is calculated from the signals in which the roll state is normal, the each probability density distribution approaches the Rayleigh distribution. On the other hand, when each of the probability density distribution of the maximal values and the probability density distribution of the minimal values is obtained when the roll state is abnormal, each probability density distribution deviates from the Rayleigh distribution.

Figure 18:
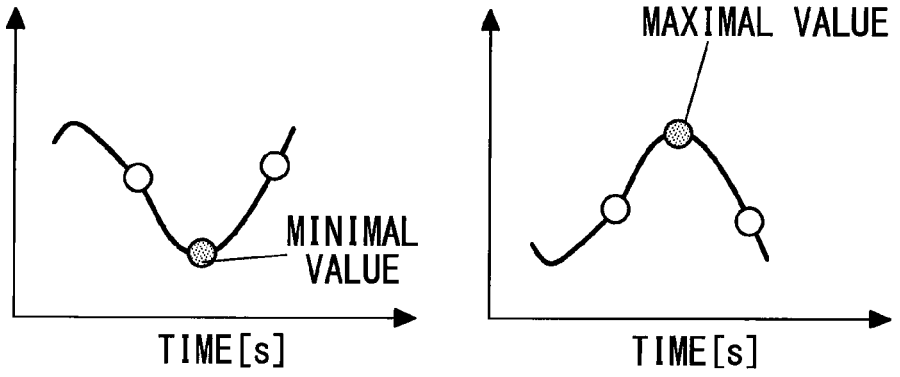
FIG. 18 is a graph illustrating a minimal value and a maximal value according to the first modification of the second embodiment.

FIG. 18 is a graph illustrating the minimal value and the maximal value according to the first modification of the second embodiment. FIG. 18 visually represents that the rolling force high frequency signal $S_{HF}$ includes a plurality of minimal values and a plurality of maximal values since each of the minimal value and the maximal value occurs one by one each time a change from one of decreasing and increasing to the other occurs in the high frequency signal waveform.

Second Modification of the Second Embodiment

As a second modification of the second embodiment, roll state determination may be performed based on comparison between each test result for each rolling stand. The "each test result for each rolling stand" may be each difference "d" calculated in each rolling stand #1 to #7. Specifically, in this second modification, each difference d may be calculated for each of the plurality of rolling stands #1 to #7 in the finishing mill 57, and these plurality of differences d may be compared to each other. The difference d in this second modification may be a difference from the normal distribution described in FIGS. 15 and 16 as above, or may be a difference from the Rayleigh distribution described in FIGS. 17 and 18.

That is, as shown in FIG. 13, each of the plurality of rolling stands #1 to #7 includes the rolling force detecting means 6, and therefore the rolling force signal processor 210 can extract each rolling force high-frequency signal $S_{HF}$ for each of the plurality of rolling stands #1 to #7 individually. In the second modification, the rolling force data processor 211 may individually calculate each difference d1 to d7 for each rolling stand #1 to #7 based on each rolling force high-frequency signal $S_{HF}$ acquired from each rolling stand #1 to #7. Each difference d is each test result for each rolling stand acquired by the following manner: each rolling force detecting means 6 in each stand outputs each rolling force signal; and then each rolling force signal is subjected to the statistical test method described in FIGS. 14 to 19.

In the second modification, when a value of "i" is an arbitrary integer, the roll state determining part 212 may compare a difference $d_i$ in an $i^{th}$ stand with a difference $d_j$ in a $j^{th}$ stand (although $j \neq i$). However, any number different from "i" will be substituted into "j", and the $j^{th}$ stand generally represents each stand other than the $i^{th}$ stand. As an example, the roll state determining part 212 may determine the monitored roll in the $i^{th}$ stand to be abnormal if the value of $d_i$ is larger or smaller than a value of multiplying a "representative value of the plural values $d_j$" by a predetermined coefficient. The predetermined coefficient may be a value such as 3, for example. The representative value of the plural values $d_j$ may be an average value of the plural values $d_j$. For example, since j=2 to 7 when i=1, the representative value of the plural values $d_j$ may be an average value of $d_2$, $d_3$, . . . $d_7$.

Figure 20:
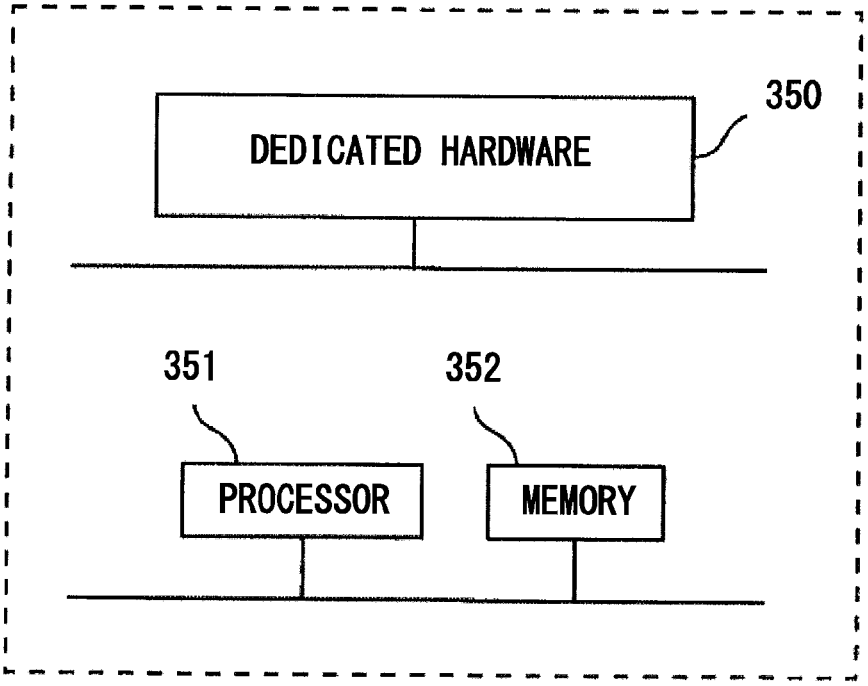
FIG. 20 is a diagram illustrating an example of hardware configuration of the roll state monitor device according to the first and second embodiments.

FIG. 20 is a diagram illustrating an example of a hardware configuration of the roll state monitor devices 20 and 220 according to the first and second embodiments. Various control operations, calculation processing and determination processing described in the first and second embodiments may be implemented in the hardware configuration described below.

The function in the roll state monitor devices 20 and 220 is implemented by processing circuitry. The processing circuitry may be a dedicated hardware 350. Alternatively, the processing circuitry may include a processor 351 and a memory 352. The processing circuitry may be partially formed of the dedicated hardware 350 and may further includes the processor 351 and the memory 352. FIG. 20 illustrates an example in which the processing circuitry is partially formed of the dedicated hardware 350 and includes the processor 351 and the memory 352.

If at least a portion of the processing circuitry is at least one dedicated hardware 350, the processing circuitry may include, for example, a single circuit, a composite circuit, a programmed processor, a parallel programmed processor, an ASIC, an FPGA, or combinations thereof.

If the processing circuitry includes at least one processor 351 and at least one memory 352, each function in the roll state monitor devices 20, 220 is implemented by software, firmware, or a combination of software and firmware. The software and the firmware are formed as programs and stored in the memory 352. The processor 351 achieves the function of each part by reading and executing the program stored in the memory 352. The processor 351 is also referred to as a CPU (Central Processing Unit), a central processing unit, a processing unit, an arithmetic unit, a microprocessor, a microcomputer, or a DSP. The memory 352 includes, for example, nonvolatile or volatile semiconductor memories such as RAMs, ROMs, flash memories, EPROMs, EEPROMs, and the like.

In this manner, the processing circuitry can achieve the function in the roll state monitor devices 20, 220 by hardware, software, firmware, or a combination thereof.

REFERENCE SIGNS LIST

1 Rolled material
2 Rolling mill housing
3*a* Work roll (upper work roll)
3*b* Work roll (lower work roll)
4*a* Backup roll (upper backup roll)
4*b* Work roll (lower backup roll)
4*c* Reference position
5 Screw down means
6 Rolling force detecting means
6*ds* drive-side rolling force detecting means
6*os* operator-side rolling force detecting means
7 Roll rotation amount detector
8 Roll reference position detector
9 Roll gap detector
10 Rolling force vertical distribution part
11 Rolling force variation extraction part
12 Roll eccentricity amount identify part
13 Roll eccentricity amount recording part
14 Roll state determination part
15 Position scale
15*a* reference position
20,220 Roll state monitor device
50,250 Rolling mill
51 Slab
52 Heating furnace
53 Roughing mill
54 Bar heater
55 Bar
56 Entry pyrometer
57 Finishing rolling mill
58 Strip thickness/width gauge
59 Delivery pyrometer
60 Pyrometer
61 Coiler
62 Product coil
63 Run-out table
111 Upper rolling force variation extracting part
112 Lower rolling force variation extracting part
111*a*, 112*a* rolling force recording unit
111*b*, 112*b* average value calculating means
111*c*, 112*c* variation calculating means
121 Upper adding means
122 Lower adding means
121*a*, 122*a* Conversion block
121*b*, 122*b* Limiter
121*c*, 122*c* Switch
121*d*, 122*d* Adder
121*e*, 122*e* Rotation amount correction block
210 Rolling force signal processing part
211 Rolling force data processing part
212 Roll state determination part
350 Dedicated hardware
351 Processor
352 Memory
OS operator side
DS drive side
RD Rolling direction
n Number of roll divisions
P Rolling force
$y_{Tj}$, $y_{T0}$, $y_{T1}$, $y_{Tn-1}$, $y_{Bj}$, $y_{B0}$, $y_{B1}$, $yB_{n-1}$ Roll eccentricity amount
ΔP Rolling force variation value
ΔS, $\Delta S_{Tj}$, $\Delta S_{Bj}$ Roll gap equivalent value
$\Delta y_{peak}$ Roll eccentricity peak-to-peak value
$\Delta y_{nor_peak}$ Normal roll eccentricity peak-to-peak value
$S_{HF}$ Rolling force high-frequency signal
D Vertical axis range
$D_n$ Section

The invention claimed is:

1. A roll state monitor device comprising:

a memory; and circuitry configured to detect rolling force of a monitored roll selected from an upper roll set and a lower roll set when a rolled material is rolled between the upper roll set and the lower roll set, the upper roll set having at least one roll and the lower roll set having at least one roll, extract a rolling force variation value based on the rolling force for each rotation position of the monitored roll, and identify a roll eccentricity amount of the monitored roll by acquiring a plurality of accumulated values by accumulating separately for each rotation position of the monitored roll a value which is one of the rolling force variation value and a roll gap equivalent value calculated based on the rolling force variation value, and by dividing each of the plurality of accumulated values by a correction coefficient, the correction coefficient being set proportional to a roll rotation number which indicates that the monitored roll is rotated a plurality of times in an accumulation period in which the plurality of accumulated values are acquired.

2. The roll state monitor device according to claim 1, wherein the circuitry is configured to convert the rolling force variation value into the roll gap equivalent value by using a force roll gap conversion equation including a plastic coefficient of the rolled material.

3. The roll state monitor device according to claim 1, wherein the circuitry is configured to detect first side rolling force of a first side end portion of the monitored roll, while detecting second side rolling force of a second side end portion of the monitored roll, the second side end portion being opposite to the first side end portion, wherein the circuitry is configured to extract each of a first side rolling force variation value and a second side rolling force variation value, the first side rolling force variation value is a value of the first side rolling force for each rotation position of the monitored roll, and the second side rolling force variation value is a value of the second side rolling force for each rotation position of the monitored roll, and wherein the circuitry is configured to acquire the plurality of accumulated values corresponding to the plurality of rotation positions based on the first side rolling force variation value and the second side rolling force variation value with respect to each of the first side end portion and the second side end portion separately, and to identify each roll eccentricity amount of the first side end portion and the second side end portion.

4. The roll state monitor device according to claim 1, wherein the circuitry is further configured to determine state of the monitored roll by collating the roll eccentricity amount to a determination criterion.

5. A roll state monitor device comprising:

a rolling force detector configured to detect rolling force of a monitored roll selected from an upper roll set and a lower roll set when a rolled material is rolled between the upper roll set and the lower roll set, the upper roll set having at least one roll and the lower roll set having at least one roll;

a force variation value extractor configured to extract a rolling force variation value which is a value of each rolling force for each rotation position of the monitored roll;

an identification part configured to identify a roll eccentricity amount for each rotation position of the monitored roll based on the rolling force variation value;

a recorder recording a plurality of roll eccentricity amounts identified by the identification part in accordance with a plurality of rotation positions of the monitored roll in a first rolling period which is determined in advance; and a roll state determining part determining state of the monitored roll in a second rolling period which is after the first rolling period, based on a normal roll eccentricity amount representative value which is a first representative value calculated from the plurality of the roll eccentricity amounts identified by the identification part in the first rolling period, and based on a plurality of roll eccentricity amounts identified by the identification part in accordance with a plurality of rotation positions of the monitored roll in the second rolling period, the normal roll eccentricity amount representative value being any one of a normal roll eccentricity amount peak-to-peak value, a normal roll eccentricity amount maximal average value, and a normal roll eccentricity amount minimal average value.

6. The roll state monitor device according to claim 5, wherein the roll state determining part is configured to determine the state of the monitored roll by comparing a second representative value of the roll eccentricity amount acquired in the second rolling period with a multiplied value acquired by multiplying the normal roll eccentricity amount representative value by a predetermined coefficient, and wherein the second representative value is the same type of numerical value as the first representative value calculated from the plurality of the roll eccentricity amounts identified by the identification part in the second rolling period.

7. The roll state monitor device according to claim 5, wherein the roll state determining part is configured to determine the state of the monitored roll based on a test result of a statistical test method for the plurality of the roll eccentricity amounts identified by the identification part in the second rolling period.

8. A roll state monitor device comprising:

a rolling force detector configured to detect rolling force of a monitored roll selected from an upper roll set and a lower roll set when a rolled material is rolled between the upper roll set and the lower roll set, the upper roll set having at least one roll and the lower roll set having at least one roll;

a force variation value extractor configured to extract a rolling force variation value which is a value of each rolling force for each rotation position of the monitored roll;

an identification part configured to identify a roll eccentricity amount for each rotation position of the monitored roll based on the rolling force variation value;

a recorder recording a plurality of roll eccentricity amounts identified by the identification part in accordance with a plurality of rotation positions of the monitored roll in a first rolling period which is determined in advance, the first rolling period being a period required to roll one or a plurality of the rolled materials; and a roll state determining part determining a state of the monitored roll in a second rolling period which is after the first rolling period, based on a normal roll eccentricity amount representative value which is a first representative value calculated from the plurality of the roll eccentricity amounts identified by the identification part in the first rolling period, and based on a plurality of roll eccentricity amounts identified by the identification part in accordance with a plurality of rotation positions of the monitored roll in the second rolling period, the second rolling period being a period having a same length as the first rolling period.

* * * * *